US007918450B2

(12) United States Patent
Yoshida

(10) Patent No.: US 7,918,450 B2
(45) Date of Patent: Apr. 5, 2011

(54) SHEET PROCESSING APPARATUS, SHEET PROCESSING METHOD, AND IMAGE FORMING APPARATUS

(75) Inventor: Hiroki Yoshida, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 30 days.

(21) Appl. No.: 12/457,935

(22) Filed: Jun. 25, 2009

(65) Prior Publication Data

US 2010/0019442 A1 Jan. 28, 2010

(30) Foreign Application Priority Data

Jul. 23, 2008 (JP) ..... 2008-189672

(51) Int. Cl.
*B65H 29/00* (2006.01)

(52) U.S. Cl. ..... 271/207; 270/58.11

(58) Field of Classification Search ..... 271/220, 271/221, 207; 270/58.08, 58.11, 58.12
See application file for complete search history.

(56) References Cited

U.S. PATENT DOCUMENTS 6,145,825 A 11/2000 Kunihiro et al.
7,240,901 B2 * 7/2007 Matsumoto et al. ..... 271/270
7,248,829 B2 * 7/2007 Kobayashi ..... 399/410
7,306,214 B2 12/2007 Iida et al.
7,410,158 B2 8/2008 Iida et al.
7,717,422 B2 * 5/2010 Matsumoto et al. ..... 271/270
2004/0256783 A1 12/2004 Iida et al.
2007/0145674 A1 * 6/2007 Saito ..... 271/207

FOREIGN PATENT DOCUMENTS

JP 2001-097631 4/2001
JP 3886135 12/2006
JP 3980834 7/2007

OTHER PUBLICATIONS

Abstract of JP 2002-211829 published Jul. 31, 2002.
Abstract of JP 2004-284824 published Oct. 14, 2004.

* cited by examiner

*Primary Examiner* — Kaitlin S Joerger
(74) *Attorney, Agent, or Firm* — Harness, Dickey & Pierce, P.L.C.

(57) ABSTRACT

When a sheet is conveyed to a position where a conveying speed can be changed from a first conveying speed to a second conveying speed while a discharging unit is discharging a preceding stack of sheets, a conveyance control unit calculates a third conveying speed for conveying the sheet based on a first conveyance time to be taken until a leading end of the stack of sheets reaches a second tray unit from a first tray unit and a second conveyance time to be taken until a current discharging operation is completed from a start of the current discharging operation, and changes the conveying speed from the first conveying speed to the third conveying speed.

15 Claims, 23 Drawing Sheets

DISCHARGE OPERATION

DISCHARGE OPERATION

SHEET PROCESSING APPARATUS, SHEET PROCESSING METHOD, AND IMAGE FORMING APPARATUS

CROSS-REFERENCE TO RELATED APPLICATIONS

The present application claims priority to and incorporates by reference the entire contents of Japanese priority document 2008-189672 filed in Japan on Jul. 23, 2008.

BACKGROUND OF THE INVENTION

1. Field of the Invention

The present invention relates to a technology for conveying a sheet discharged from an upper-level apparatus to a predetermined position for performing a post processing of the sheet.

2. Description of the Related Art

A typical sheet processing apparatus is configured such that it conveys a sheet received from an image forming apparatus, such as a copier or a printer, to an intermediate processing tray one by one; then performs post processing (for example, a stapling process) set in advance by a user through an operation screen of the image forming apparatus on a stack of sheets stacked in the intermediate processing tray; then discharges the stack of sheets out of the intermediate processing tray after the post processing is completed; and then receives a next sheet from the image forming apparatus.

In such a sheet processing apparatus, it is necessary to assure a processing time for performing a process on the stack of sheets in the intermediate processing tray. Therefore, feeding of a next sheet from the image forming apparatus is sometimes suspended until the process is finished, which leads to degradation in productivity.

In consideration of the fact that an interval between sheets fed by the image forming apparatus is usually constant, Japanese Patent Application Laid-open No. 2001-97631 discloses a sheet processing apparatus having a sheet buffering mechanism that can temporarily stacks therein sheets so that a processing time for performing post processing or sheet-stack discharge processing can be assured.

However, to arrange the sheet buffering mechanism in the sheet processing apparatus, a space for the sheet buffering mechanism needs to be assured inside the sheet processing apparatus. Therefore, the size of the sheet processing apparatus increases or necessary cost increases.

Japanese Patent No. 3980834 discloses a sheet processing apparatus that controls a sheet conveying speed such that an interval between sheets (time interval) can be increased so that an operational time necessary for performing a sorting process, a sheet feed back process, or an alignment process on sheets can be assured.

A sheet processing apparatus that controls a sheet conveying speed is also disclosed in, for example, Japanese Patent No. 3886135. Specifically, the sheet processing apparatus is configured to accelerate the sheet conveying speed from a first speed to a second speed at a first timing so that a distance between a sheet being conveyed by a conveying unit and a sheet to be conveyed next can be increased. When a sheet being conveyed is the last sheet in a preceding stack of sheets, the sheet conveying speed is accelerated from the first speed to the second speed at a second timing that is delayed from the first timing.

However, in such a sheet processing apparatus, when the sheet conveying speed is accelerated at the second timing, a distance for which the sheet is conveyed at the second speed becomes extremely short. Therefore, the sheet conveying speed needs to be rapidly accelerated and then rapidly decelerated. As a result, the sheet may be damaged such that the sheet is torn or dirtied, or performance of the conveying unit such as a stepper motor may be degraded.

As described above, when arranging a mechanism for temporarily stacking therein a sheet so that a time for performing post processing or sheet-stack discharge processing can be assured in the sheet processing apparatus, a space for the mechanism needs to be assured in the sheet processing apparatus. Therefore, the size of the sheet processing apparatus increases.

Furthermore, when the sheet processing apparatus is provided with a control unit that controls the sheet conveying speed, because the sheet conveying speed is sometimes changed rapidly, loads applied to various components including sheets increase. Therefore, the sheet may be torn or dirtied, or performance of the components such as a feed drive source may be degraded.

SUMMARY OF THE INVENTION

It is an object of the present invention to at least partially solve the problems in the conventional technology.

According to one aspect of the present invention, there is provided a sheet processing apparatus including a conveying unit that conveys a sheet from an upper-level apparatus; a conveyance control unit that changes a conveying speed of the sheet from a first conveying speed to a second conveying speed to extend an interval between a current sheet and a next sheet from the upper-level device increases; a first tray unit that stacks therein the sheet conveyed by the conveying unit; an aligning unit that aligns sheets stacked in the first tray unit; a second tray unit that stacks therein a stack of sheets discharged from the first tray unit; a discharging unit that discharges the stack of sheets from the first tray unit to the second tray unit; and a holding unit that holds a trailing end of the stack of sheets stacked in the second tray unit. When a sheet is conveyed to an acceleration position where the conveying speed can be changed from the first conveying speed to the second conveying speed while the discharging unit is discharging a preceding stack of sheets, the conveyance control unit calculates a third conveying speed for conveying the sheet based on a first conveyance time to be taken until a leading end of the stack of sheets reaches the second tray unit and a second conveyance time to be taken until a current discharging operation of the stack of sheets is completed from a start of the current discharging operation, and changes the conveying speed from the first conveying speed to the third conveying speed.

Furthermore, according to another aspect of the present invention, there is provided a sheet processing method including conveying a sheet from an upper-level apparatus to a first tray unit; controlling including changing a conveying speed of the sheet from a first conveying speed to a second conveying speed to extend an interval between a current sheet and a next sheet from the upper-level device increases; aligning sheets stacked in the first tray unit; discharging a stack of sheets from the first tray unit to a second tray unit; and holding a trailing end of the stack of sheets stacked in the second tray unit. When a sheet is conveyed to an acceleration position where the conveying speed can be changed from the first conveying speed to the second conveying speed while a preceding stack of sheets is discharged at the discharging, the controlling includes calculating a third conveying speed for conveying the sheet based on a first conveyance time to be taken until a leading end of the stack of sheets reaches the second tray unit and a second conveyance time to be taken until a current discharging operation of the stack of sheets is completed from a start of the current discharging operation and changing the conveying speed from the first conveying speed to the third conveying speed.

Moreover, according to still another aspect of the present invention, there is provided an image forming apparatus including a sheet processing device. The sheet processing device includes a conveying unit that conveys a sheet from an upper-level apparatus; a conveyance control unit that changes a conveying speed of the sheet from a first conveying speed to a second conveying speed to extend an interval between a current sheet and a next sheet from the upper-level device increases; a first tray unit that stacks therein the sheet conveyed by the conveying unit; an aligning unit that aligns sheets stacked in the first tray unit; a second tray unit that stacks therein a stack of sheets discharged from the first tray unit; a discharging unit that discharges the stack of sheets from the first tray unit to the second tray unit; and a holding unit that holds a trailing end of the stack of sheets stacked in the second tray unit. When a sheet is conveyed to an acceleration position where the conveying speed can be changed from the first conveying speed to the second conveying speed while the discharging unit is discharging a preceding stack of sheets, the conveyance control unit calculates a third conveying speed for conveying the sheet based on a first conveyance time to be taken until a leading end of the stack of sheets reaches the second tray unit and a second conveyance time to be taken until a current discharging operation of the stack of sheets is completed from a start of the current discharging operation, and changes the conveying speed from the first conveying speed to the third conveying speed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
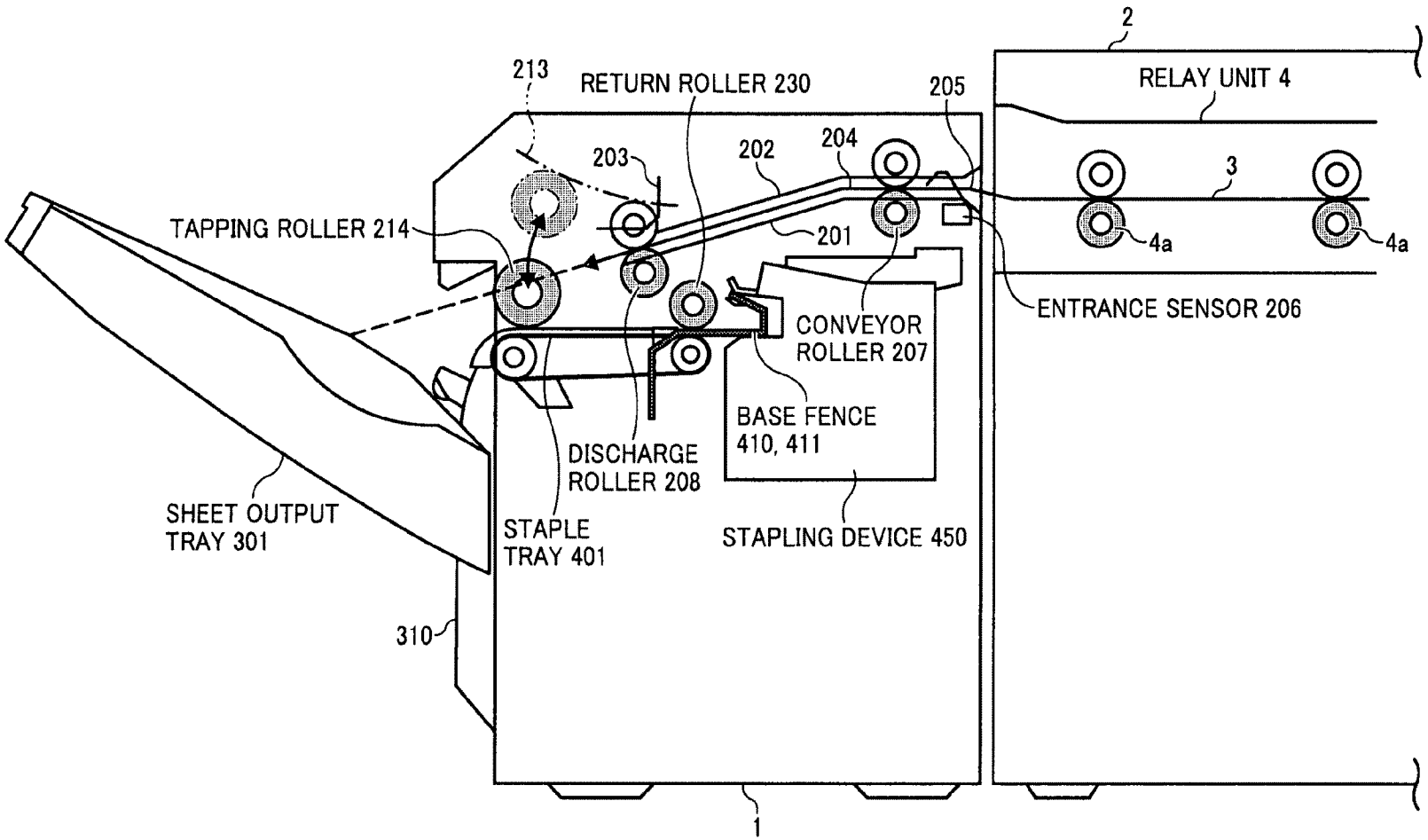
FIG. 1 is a schematic diagram of a sheet post-processing apparatus according to an embodiment of the present invention.

FIG. 1 is a schematic diagram of a sheet post-processing apparatus 1 according to an embodiment of the present invention. The sheet post-processing apparatus 1 includes a conveying guide plate 201, an open-close guide plate 202 capable of rotating upward, and a sheet-discharge guide plate 203. A conveying path 204 is formed by the conveying guide plate 201, the open-close guide plate 202, and the sheet-discharge guide plate 203.

A feed entrance 205 is opened between the conveying guide plate 201 and the open-close guide plate 202 in the most upstream area of the conveying path 204 in a sheet conveying direction. The feed entrance 205 is connected to a conveying path 3 of an upper-level device 2, such as an image forming apparatus, via a relay unit 4 that includes a plurality of discharge rollers 4*a*.

An entrance sensor 206 that detects a position of a sheet is arranged near the feed entrance 205 and inside the sheet post-processing apparatus 1. A pair of conveyor rollers 207 is arranged near and downstream of the entrance sensor 206 in the sheet conveying direction. A pair of discharge rollers 208 is arranged in the downstream area of the conveying path 204.

Figure 2:
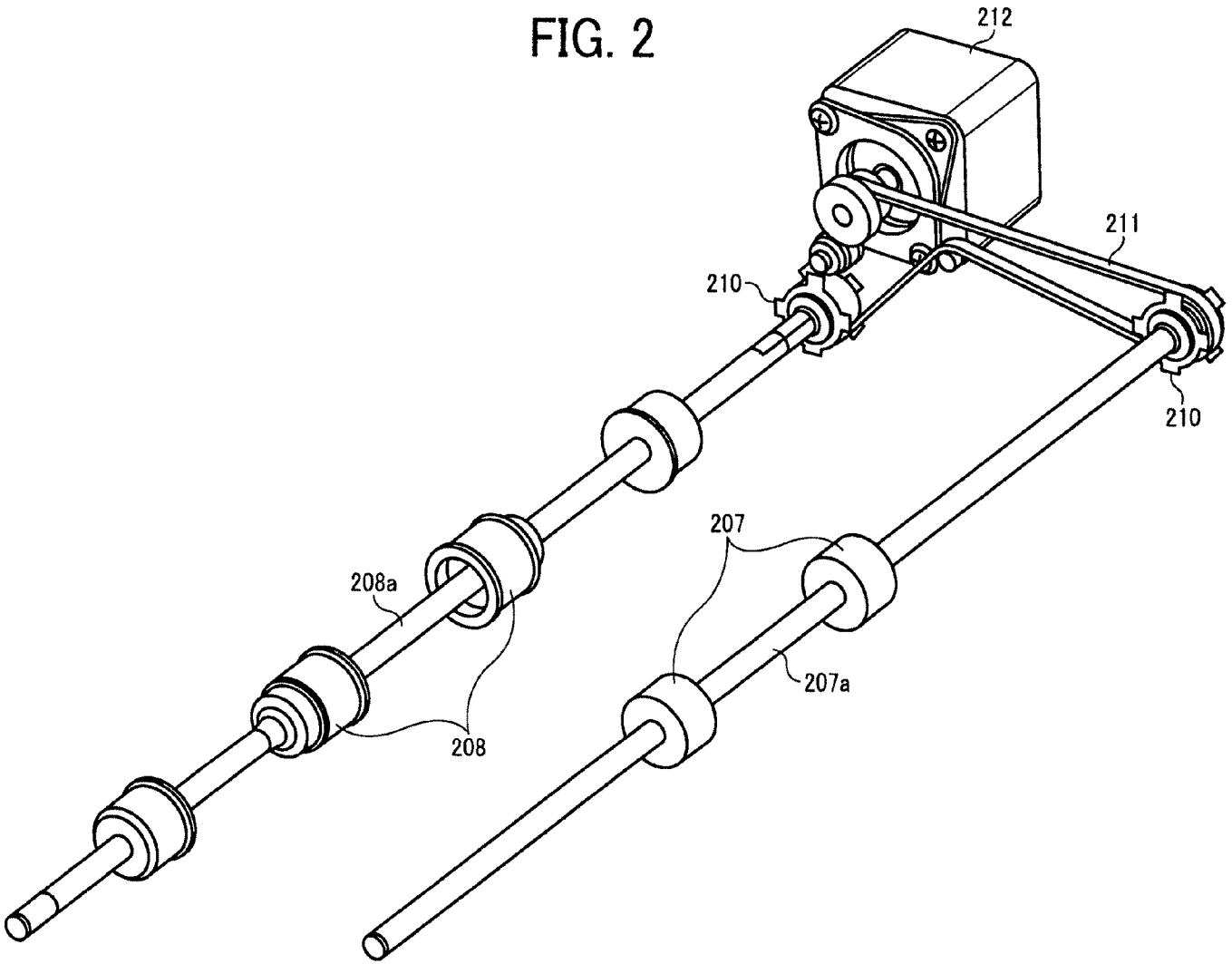
FIG. 2 is a perspective view of a pair of conveyor rollers and a pair of discharge rollers shown in FIG. 1.

FIG. 2 is a perspective view of the conveyor rollers 207 and the discharge rollers 208. A drive-side roller shaft 207*a* of the conveyor rollers 207 and a drive-side roller shaft 208*a* of the discharge rollers 208 are connected to a stepper motor 212 via pulleys 210 and a timing belt 211. The conveyor rollers 207 and the discharge rollers 208 rotate along rotation of the stepper motor 212 that is a conveyor drive motor.

Figure 3A:
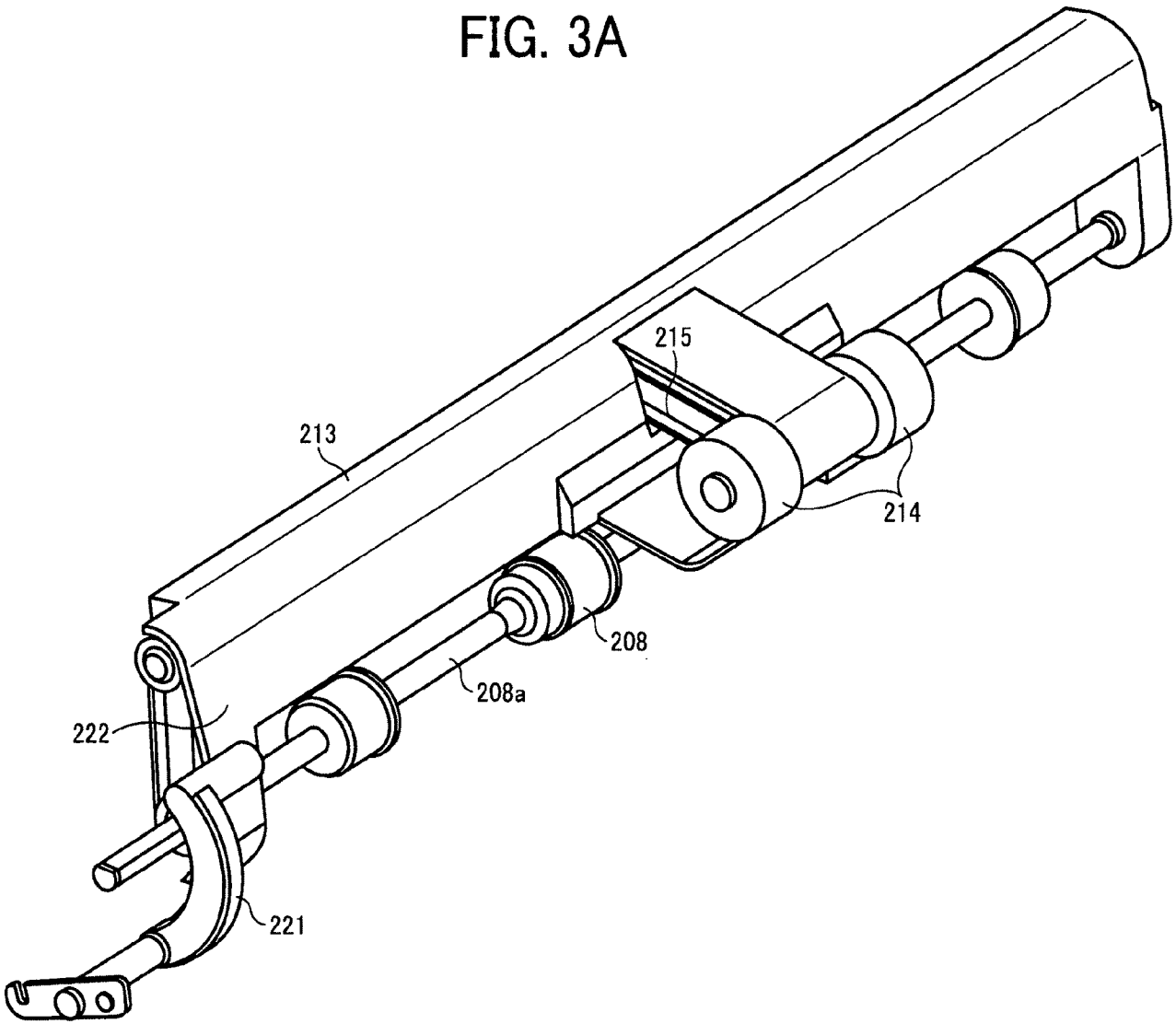
FIGS. 3A and 3B are perspective views of components arranged near the discharge rollers shown in FIG. 2.
Figure 3B:
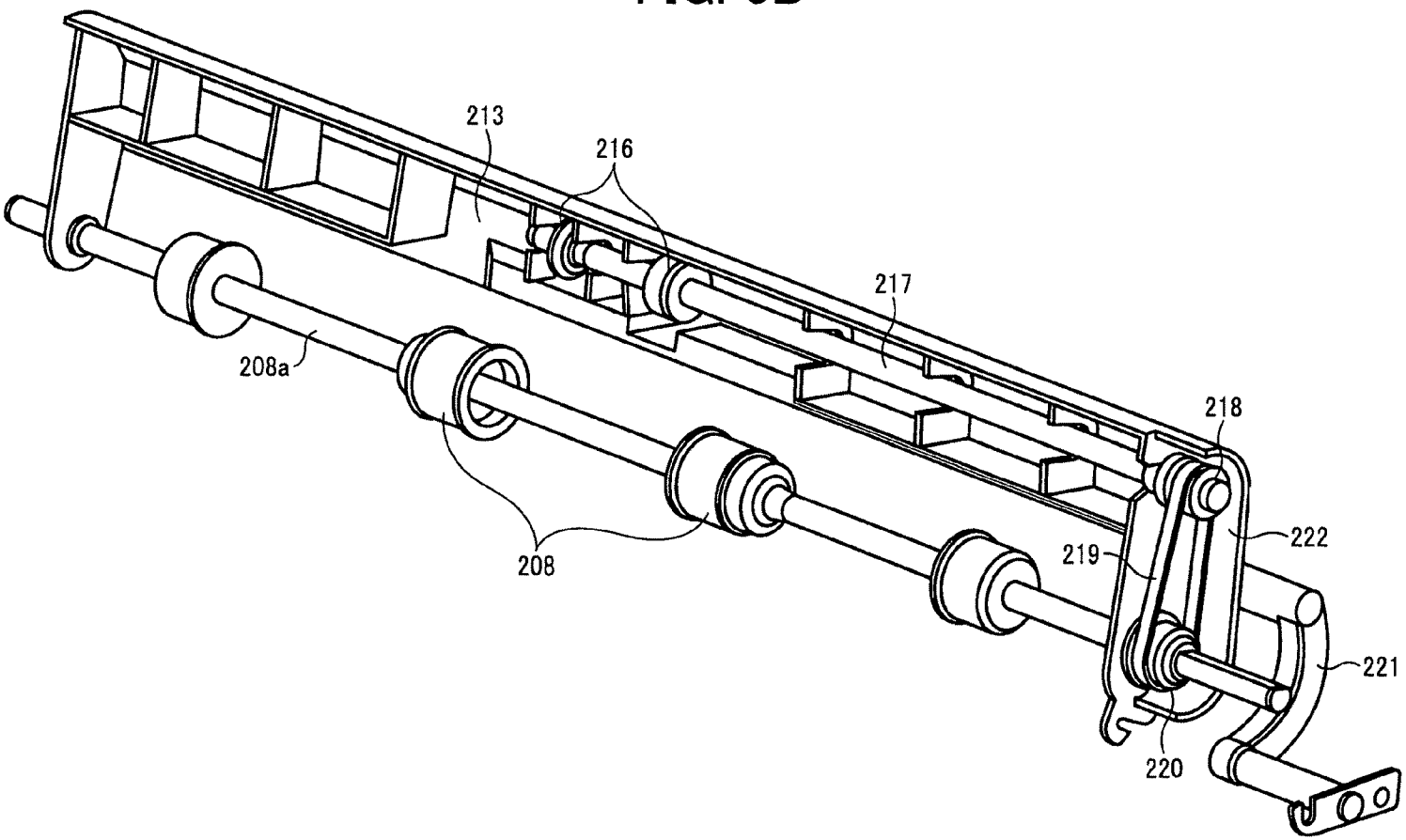

FIG. 3A is a perspective front view of components arranged near the discharge rollers 208. FIG. 3B is a perspective rear view of the components arranged near the discharge rollers 208.

As shown in FIGS. 3A and 3B, a swing arm 213 is rotatably mounted on the drive-side roller shaft 208*a* of the discharge rollers 208 in a coaxial manner. The swing arm 213 includes a tapping roller 214 made of elastic friction member (for example, member made of sponge material). The tapping roller 214 is connected to a pulley 220 that is fixedly mounted on the drive-side roller shaft 208*a*, via a timing belt 215, pulleys 216, a shaft 217, a pulley 218, and a timing belt 219. The tapping roller 214 rotates along rotation of the drive-side roller shaft 208*a* in the same rotation direction.

The swing arm 213 is always biased by gravity or a spring (not shown) towards a staple tray 401 (a first tray unit) shown in FIG. 1. The swing arm 213 is maintained at a position in contact with a stopper unit 222 by a lever 221 that is biased in a direction opposite to a bias direction of the swing arm 213. The lever 221 rotates in a reciprocating manner. Due to the reciprocating rotation of the lever 221, the swing arm 213 rotates towards the staple tray 401 such that the tapping roller 214 comes into contact with the staple tray 401. Then, the swing arm 213 comes into contact with the stopper unit 222 again and stops at that position.

Figure 4:
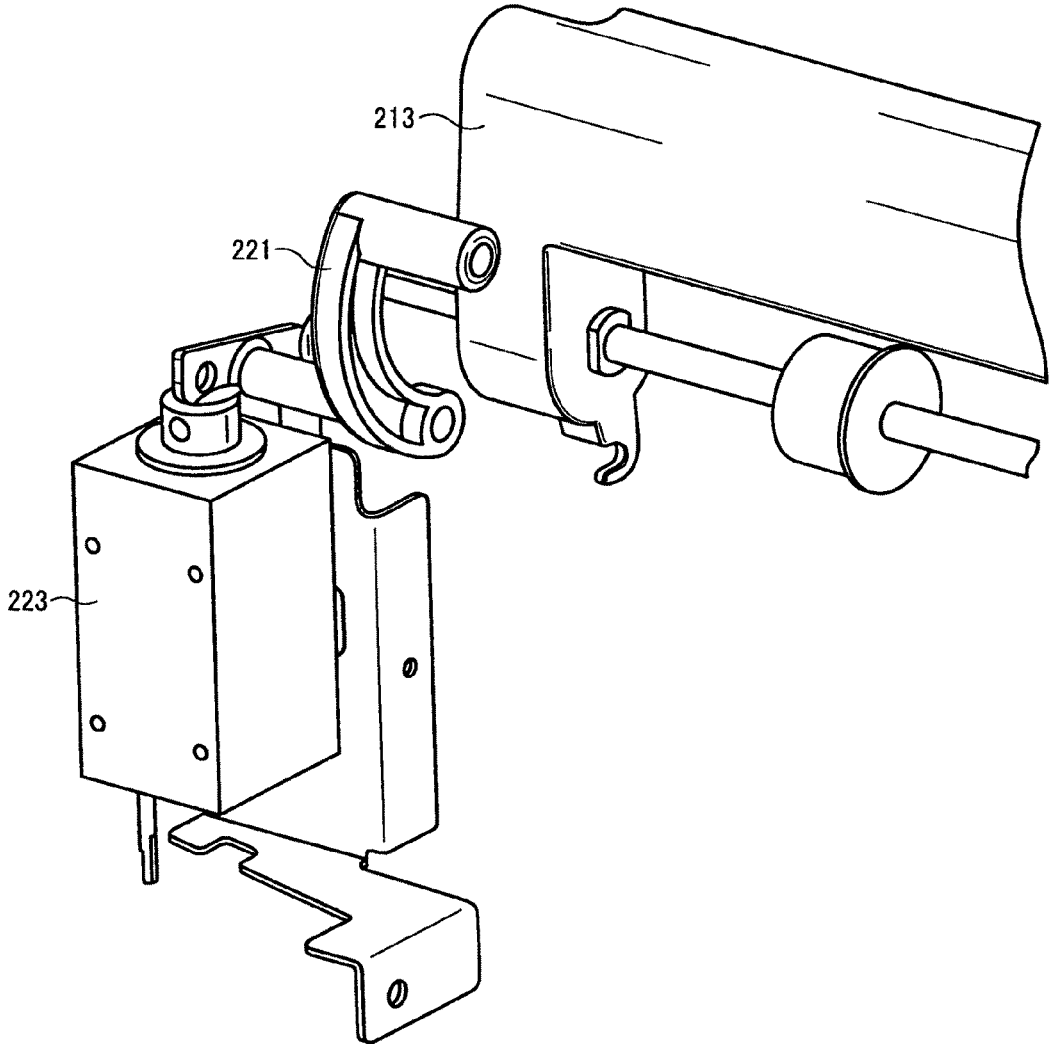
FIG. 4 is a perspective view of a driving unit that drives a lever shown in FIGS. 3A and 3B.
Figure 5:
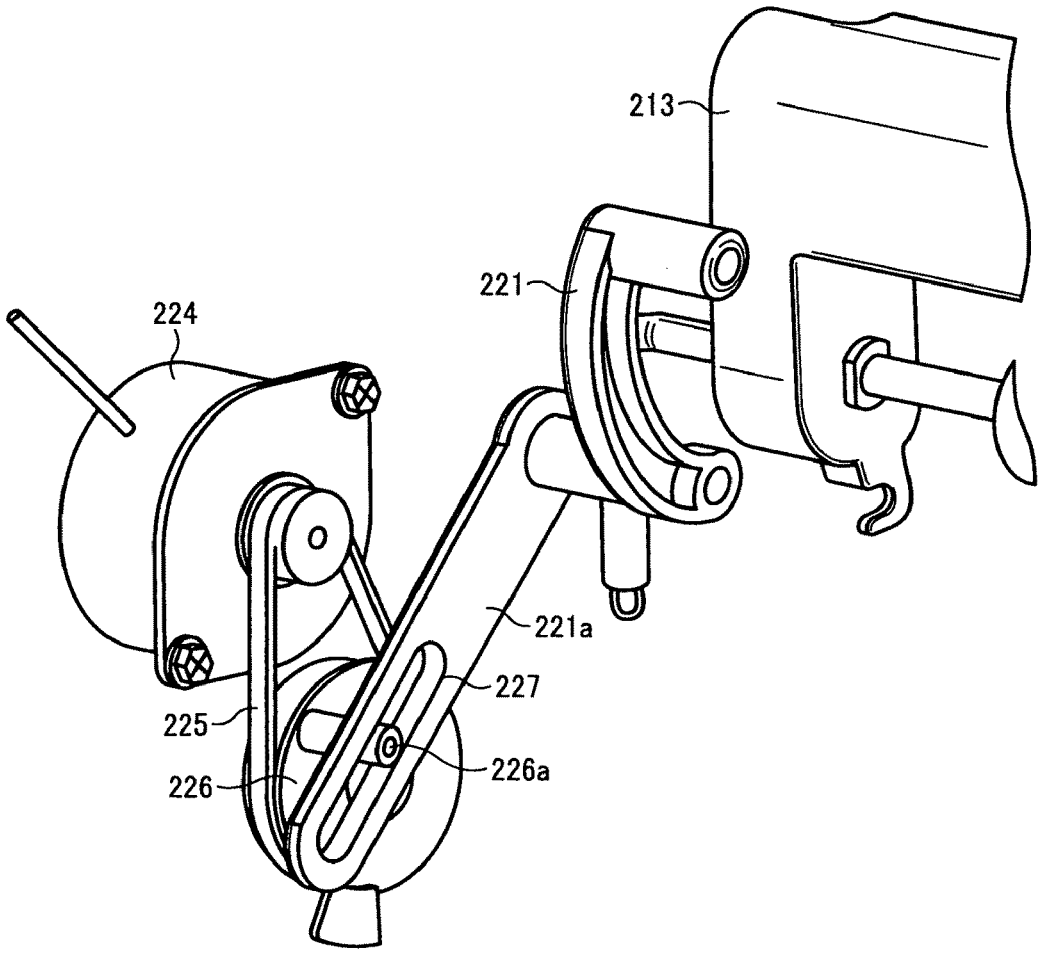
FIG. 5 is a perspective view of another driving unit that drives the lever shown in FIGS. 3A and 3B.

FIGS. 4 and 5 are schematic diagrams of driving units that drive the lever 221.

In the example shown in FIG. 4, a DC/SOL 223 that is a direct-current solenoid device and connected to the lever 221 drives the lever 221 to rotate in a reciprocated manner.

In the example shown in FIG. 5, a cam 226 that is connected to a stepper motor 224 via a timing belt 225 is caused to rotate along rotation of the stepper motor 224, so that the lever 221 connected to the cam 226 such that a cam protruded portion 226*a* is inserted into a link portion 227 of an arm 221*a* extended from the lever 221 can rotate.

Figure 6:
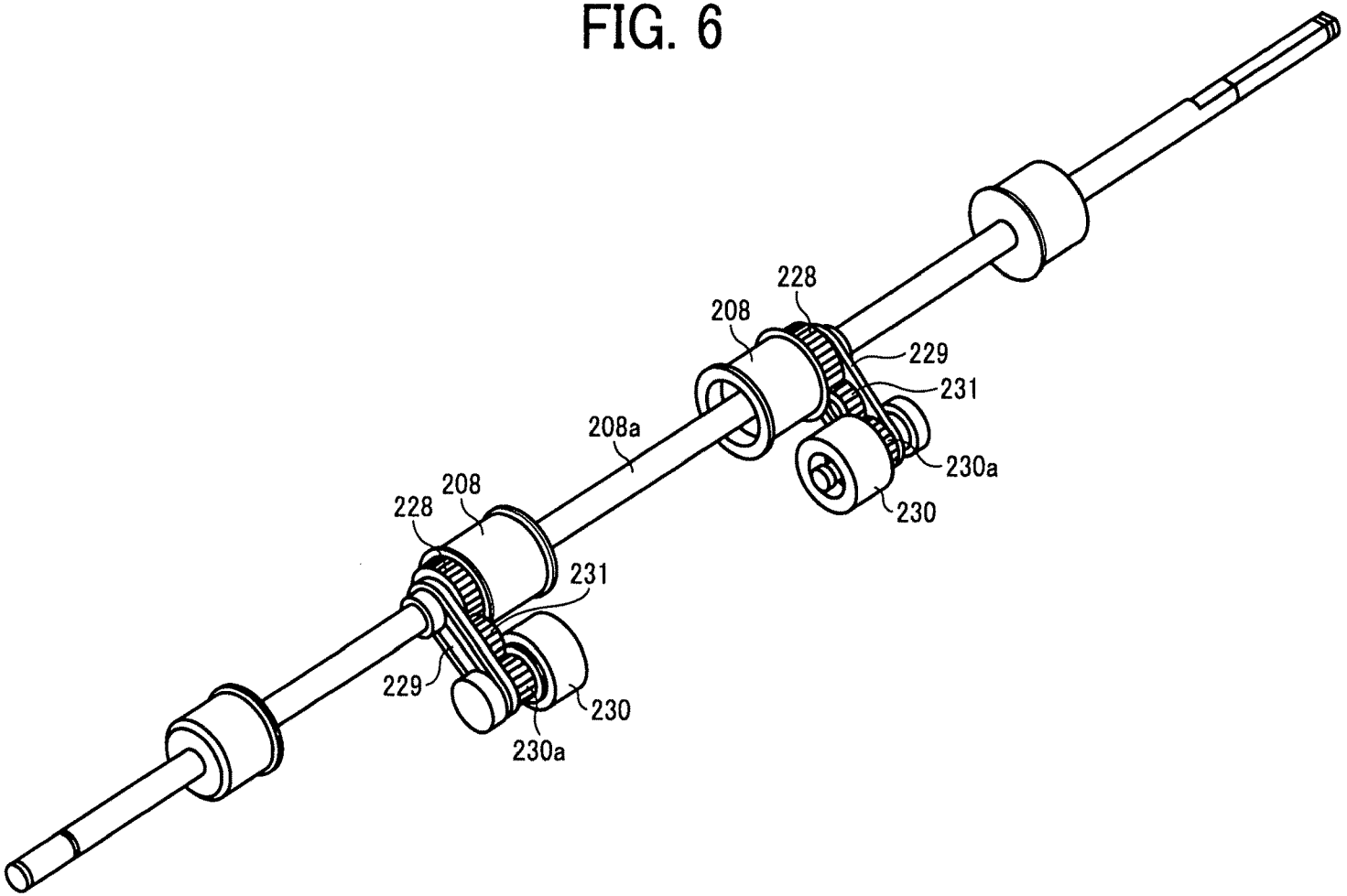
FIG. 6 is a perspective view of a drive-side roller shaft of the discharge rollers shown in FIG. 2.

FIG. 6 is a perspective view of the drive-side roller shaft 208*a* of the discharge rollers 208. The drive-side roller shaft 208*a* is engaged with gears 228. Holders 229 are rotatably mounted on the drive-side roller shaft 208*a*. Each of the holders 229 includes a return roller 230 made of elastic friction member (for example, member made of sponge material) such that a drive gear 230*a* of the return roller 230 is engaged with each of the gears 228 via an intermediate gear 231. Due to this configuration, rotation of the drive-side roller shaft 208*a* is transmitted to the return rollers 230. The holders 229 are always biased towards the staple tray 401 by gravity and weight of the return rollers 230, so that the return rollers 230 rotate such that circumferences of the return rollers 230 are always in contact with the staple tray 401.

Figure 7:
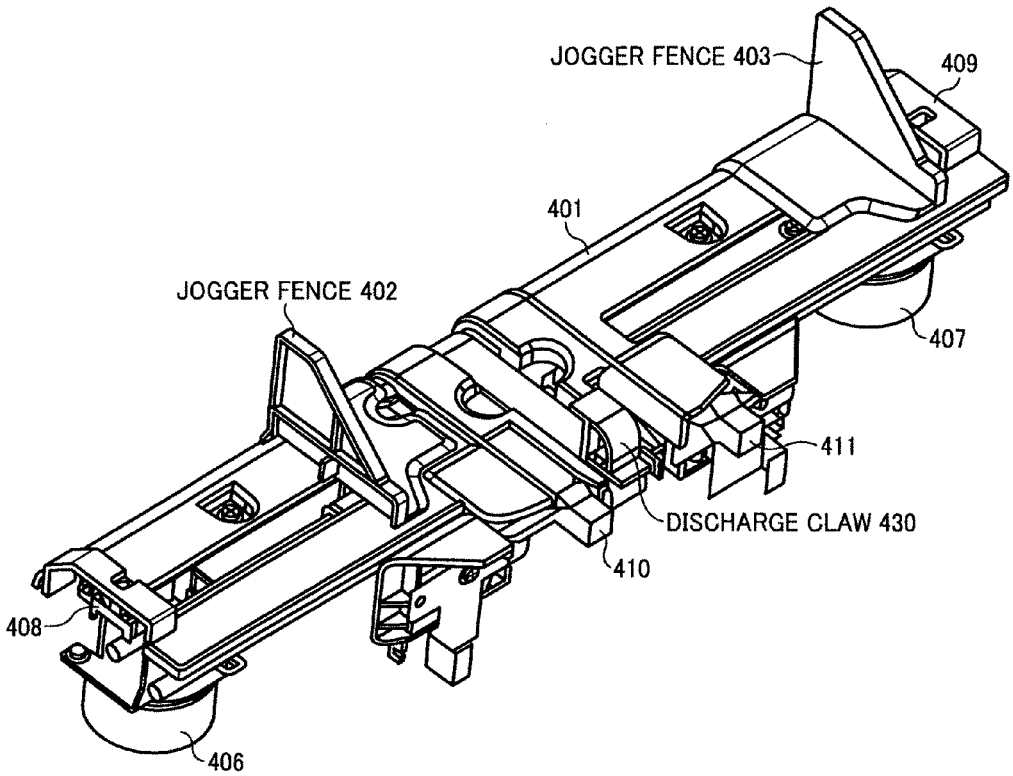
FIG. 7 is a perspective view of a sheet aligning unit according to the embodiment.

A configuration of a sheet aligning unit according to the embodiment is described below. FIG. 7 is a perspective view of the sheet aligning unit.

As shown in FIG. 7, a pair of jogger fences 402 and 403, each of which corresponding to an aligning unit and an alignment plate, is mounted on the staple tray 401 shown in FIG. 1. Each of the jogger fences 402 and 403 is inserted into a guide shaft (not shown) that is fixedly mounted on the staple tray 401. The jogger fences 402 is connected to a stepper motor 406 via a timing belt (not shown), and the jogger fence 403 is connected to a stepper motor 407 via a timing belt (not shown). The jogger fences 402 and 403 linearly reciprocate along bidirectional rotation of the stepper motors 406 and 407, respectively.

A home sensor 408 that detects a standby position of the jogger fence 402, and a home sensor 409 that detects a standby position of the jogger fence 403 are mounted on the staple tray 401. Base fences 410 and 411 to which a trailing end of a sheet abuts when the sheet is aligned are also mounted on the staple tray 401.

Figure 8:
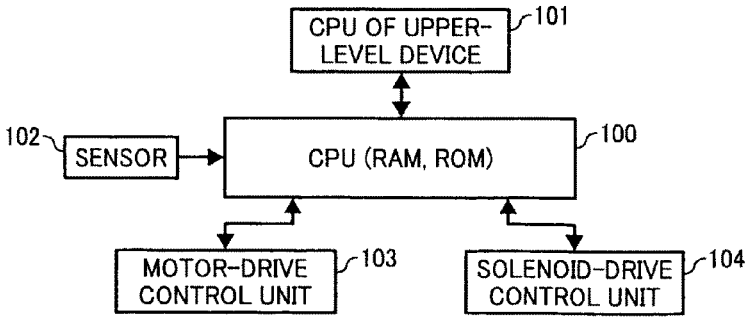
FIG. 8 is a block diagram of a control system according to the embodiment.

FIG. 8 is a block diagram of a control system according to the embodiment. A conveyance control unit is constituted of a central processing unit (CPU) 100 and a memory device such as a random access memory (RAM) and a read only memory (ROM). The CPU 100 receives an instruction signal from a CPU 101 of the upper-level device 2 or detection output from a sensor 102 such as the entrance sensor 206, and controls a motor-drive control unit 103, a solenoid-drive control unit 104, various units of constituent components, and the like. The motor-drive control unit 103 controls driving of various drive motors including the stepper motor 212. The solenoid-drive control unit 104 controls driving of various solenoid devices including the DC/SOL 223.

Figure 9:
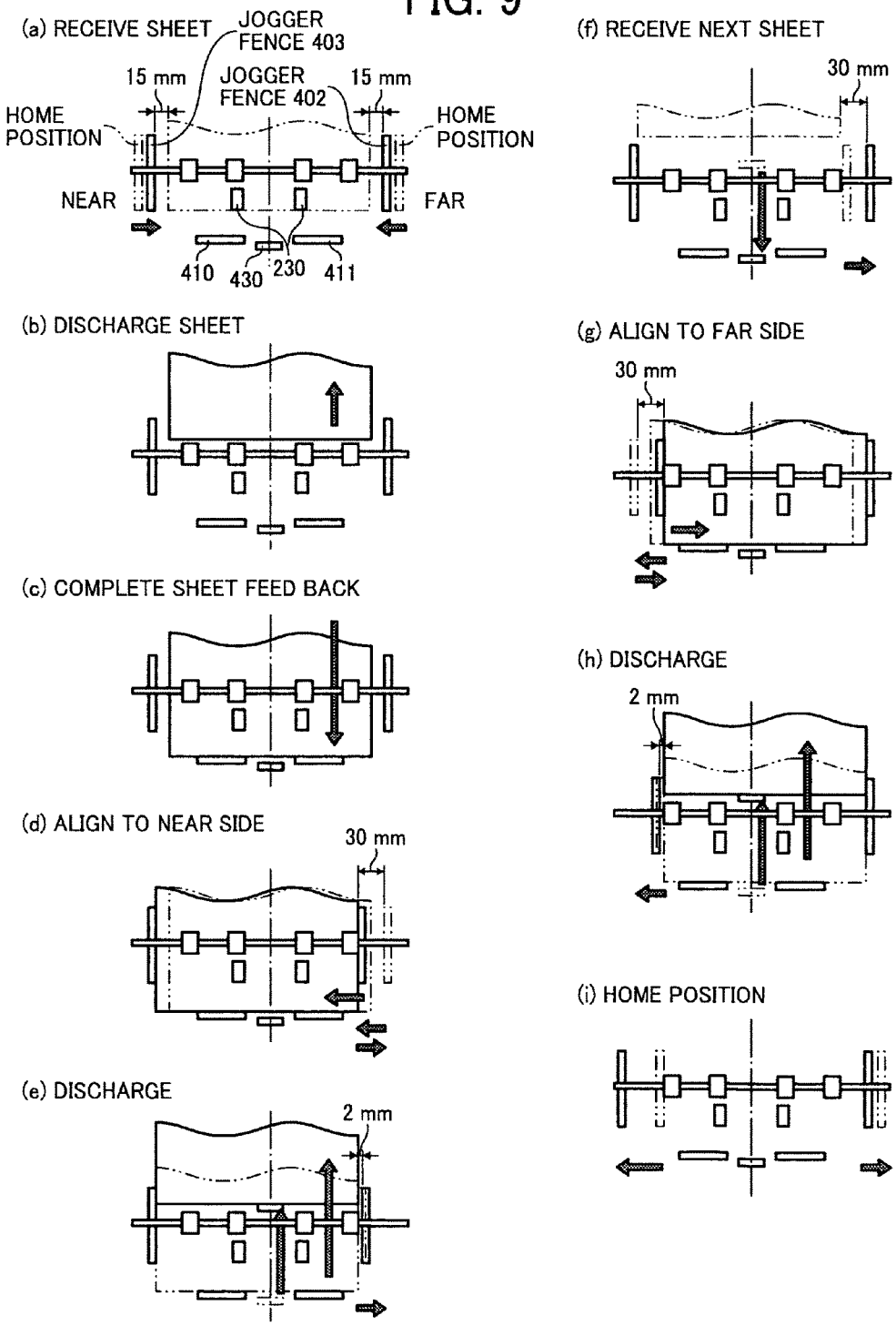
FIG. 9 is a schematic diagram for explaining a sheet alignment operation (shift mode) performed by jogger fences shown in FIG. 7.
Figure 10:
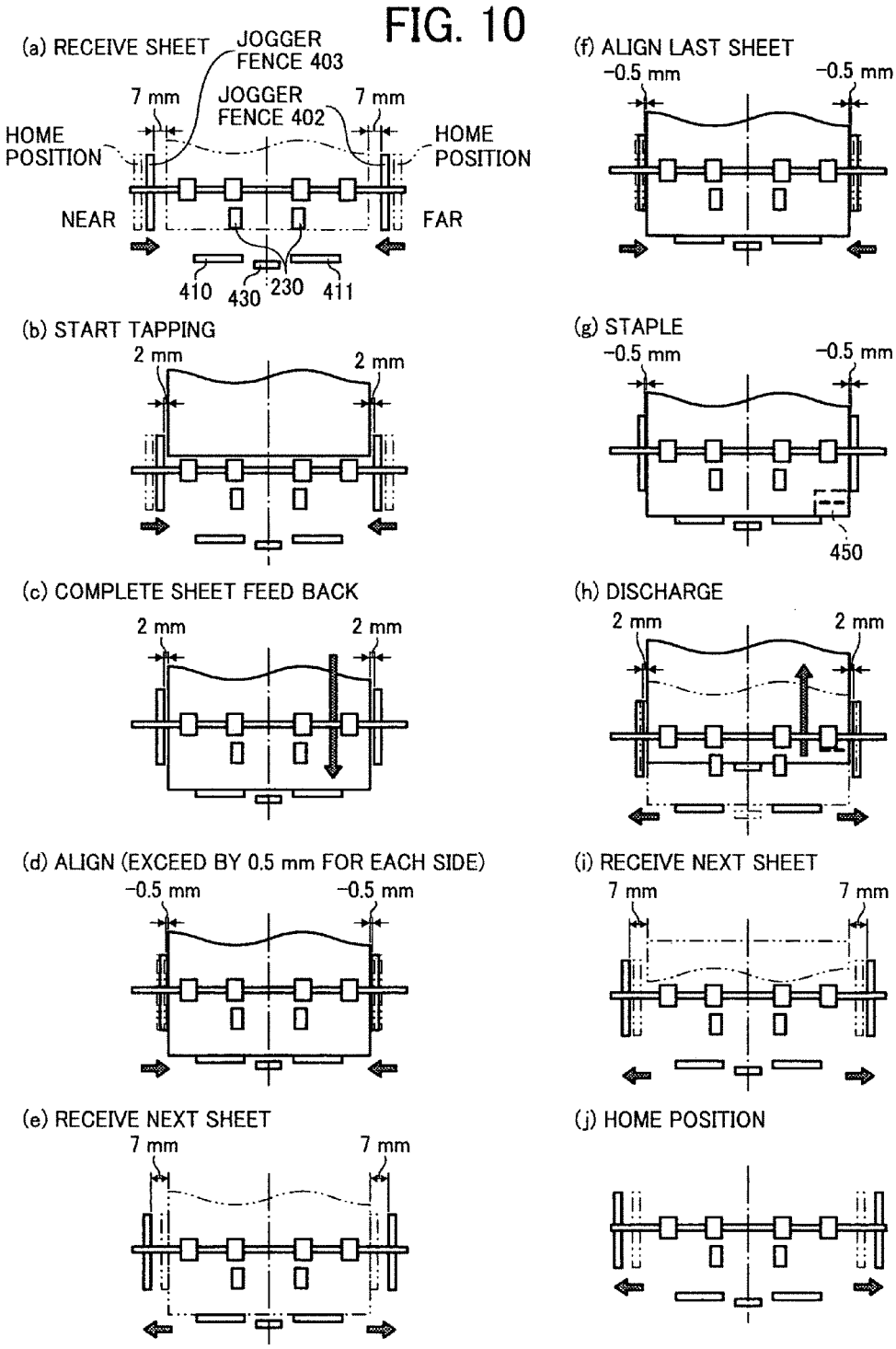
FIG. 10 is a schematic diagram for explaining a sheet alignment operation (staple mode) performed by the jogger fence shown in FIG. 7.

FIGS. 9 and 10 are schematic diagrams for explaining a sheet alignment operation performed by the jogger fences 402 and 403. When the CPU 100 of the sheet post-processing apparatus 1 receives a sheet discharge signal from the CPU 101 of the upper-level device 2, each of the jogger fences 402 and 403 moves to a receiving position depending on a width of a sheet P to be conveyed. In a shift mode (sort mode) shown in FIG. 9, the receiving positions to which the jogger fences 402 and 403 move correspond to positions shifted by 15 millimeters from side edges of the sheet P in a sheet width direction. In a staple mode shown in FIG. 10, the receiving positions correspond to positions shifted by 7 millimeters from the side edges of the sheet P in the sheet width direction.

Assuming that a sheet P in an N-th stack of sheets is aligned in the shift mode shown in FIG. 9, as shown in (a) of FIG. 9 to (d) of FIG. 9, when a trailing end of the sheet P passes through the discharge rollers 208 shown in FIG. 1, the tapping roller 214 and the return rollers 230 convey the sheet P such that a trailing end of the sheet P comes into contact with the base fences 410 and 411. Then, the jogger fence 402 (a far side) that functions as a shift member moves 30 millimeters towards the jogger fence 403 (a near side) that functions as a base member, so that a side edge of the sheet P is brought into contact with the jogger fence 403, whereby the sheet P is aligned. Then, the jogger fence 402 moves back 30 millimeters to the receiving position, and waits for a next sheet to be discharged. The same operation is sequentially repeated on discharged sheets, so that a stack of sheets is aligned along the jogger fence 403 that functions as the base member.

After a predetermined number of sheets are aligned as one stack of sheets, and the stack of sheets is output to a sheet output tray 301 (a second tray unit) shown in FIG. 1 ((e) of FIG. 9), the jogger fence 402 switches over its function from the shift member to the base member and the jogger fence 403 switches over its function from the base member to the shift member. Accordingly, sheets in an N+1-th stack of sheets are shifted in a direction opposite to the N-th stack of sheets ((f) of FIG. 9 to (h) of FIG. 9). By repeating the same process for a predetermined number of times, multiple sets of sheets can be shifted from one to the other when stacked on the sheet output tray 301. After the process is completed, the jogger fences 402 and 403 move to home positions and wait for a next sheet to be discharged ((i) of FIG. 9).

Operation timings of the jogger fences 402 and 403 are controlled by the CPU 100 based on the number of driving steps of the stepper motor 212, which is a conveyor drive motor, from when the entrance sensor 206 detects passage of the trailing end of the sheet. In other words, the CPU 100 controls the operation timings based on a conveyed distance of the sheet.

Assuming that the sheet P in the N-th stack of sheets is aligned in the staple mode shown in FIG. 10, as shown in (a) of FIG. 10 to (c) of FIG. 10, when a trailing end of the sheet P passes through the discharge rollers 208 shown in FIG. 1 and the tapping roller 214 starts rotating, the jogger fences 402 and 403 move 5 millimeters towards the center of the sheet P so that the jogger fences 402 and 403 stop at positions shifted by 2 millimeters from side edges of the sheet P in the sheet width direction. Then, when the trailing end of the sheet P comes into contact with the base fences 410 and 411, the jogger fences 402 and 403 further move 2.5 millimeters towards the center of the sheet P, so that the sheet P is aligned in the center. Then, the jogger fences 402 and 403 move back to and stop at the receiving positions and wait for a next sheet to be discharged ((e) of FIG. 10). The jogger fences 402 and 403 sequentially repeat the same operation on subsequently-discharged sheets, so that a stack of sheets is aligned in the center.

After a predetermined number of sheets are aligned as one stack of sheets ((f) of FIG. 10), a stitching device (stapling device) 450 (a stapling unit) shown in FIG. 1 performs a stapling process such that a predetermined portion near the leading end of the stack of sheets is stapled ((g) of FIG. 10). Then, a discharge claw 430 discharges the stack of sheets to the sheet output tray 301 ((h) of FIG. 10). The jogger fences 402 and 403 move to the receiving positions so that they can receive a sheet in the N+1-th stack of sheets ((i) of FIG. 10), and then perform the same processes of alignment, stapling, and discharging on sheets in the N+1-th stack of sheets. After the processes are completed, the jogger fences 402 and 403 move back to the home positions and wait for a next sheet to be discharged ((j) of FIG. 10).

Similar to the process in the shift mode, operation timings of the jogger fences 402 and 403 are controlled by the CPU 100 based on the number of driving steps of the stepper motor 212, which is a conveyor drive motor, from when the entrance sensor 206 detects passage of the trailing end of the sheet. In other words, the CPU 100 controls the operation timings based on a conveyed distance of the sheet.

A timing of conveying a sheet (a sheet in the N-th stack of sheets) in a sheet conveying operation according to the embodiment, which starts from sheet receiving and ends with sheet alignment, is described below with reference to FIGS. 11, 12, and 1.

A sheet in the N-th stack of sheets is fed from the image forming apparatus at a receiving line speed V1 (first conveying speed), and enters the feed entrance 205 at the same speed. When the sheet is conveyed for a predetermined distance after the entrance sensor 206 detects passage of a leading end of the sheet, that is, when the leading end of the sheet reaches the conveyor rollers 207 (a acceleration allowed timing T1), rotation speed of the stepper motor 212 that is a conveyor drive motor is accelerated from the receiving line speed V1 to a conveyor line speed V2 (second conveying speed). Accordingly, a conveying speed of the sheet is accelerated to the conveyor line speed V2.

When the sheet is continuously conveyed at the conveyor line speed V2 along the conveying path 204 for a predetermined distance after a trailing end of the sheet passes through the entrance sensor 206 (i.e., when the trailing end of the sheet reaches a position upstream of the discharge rollers 208 by 30 millimeters), the rotation speed of the stepper motor 212 is decelerated, so that the conveying speed of the sheet is also decelerated. Specifically, the conveying speed is decelerated to a discharge line speed V4 (fourth conveying speed), which depends on a sheet size, and the sheet is discharged onto the staple tray 401 by the discharge rollers 208 at the discharge line speed V4.

When the sheet is conveyed for a predetermined distance after the trailing end of the sheet passes through the entrance sensor 206 and the discharge rollers 208 (i.e., when the sheet is conveyed for about 5 millimeters after the trailing end of the sheet passes through the discharge rollers 208), the DC/SOL 223 shown in FIG. 4 (or the stepper motor 224 shown in FIG. 5) drives the lever 221 to rotate. Accordingly, the swing arm 213 rotates towards the staple tray 401, and the tapping roller 214 is brought into contact with around the trailing end of the sheet discharged on the staple tray 401. Due to the rotation of the tapping roller 214 that is in contact with the sheet, the sheet is conveyed such that the trailing end of the sheet can be brought into contact with the base fences 410 and 411 (trailing-end aligning units). The sheet whose trailing end is brought into contact with the base fences 410 and 411 is further conveyed towards the base fences 410 and 411 due to the rotation of the return rollers 230, and then posture of the sheet is maintained.

In this manner, by accelerating the conveying speed of the sheet in the N-th stack of sheets from the receiving line speed V1 to the conveyor line speed V2 at the acceleration allowed timing T1, an interval between the sheet and a next sheet can be increased by ΔT1. Accordingly, the sheet alignment operation can be performed during the increased interval, so that interference between sequentially-conveyed sheets can be prevented.

A configuration of the sheet output tray 301 is described in detail below.

Figure 13:
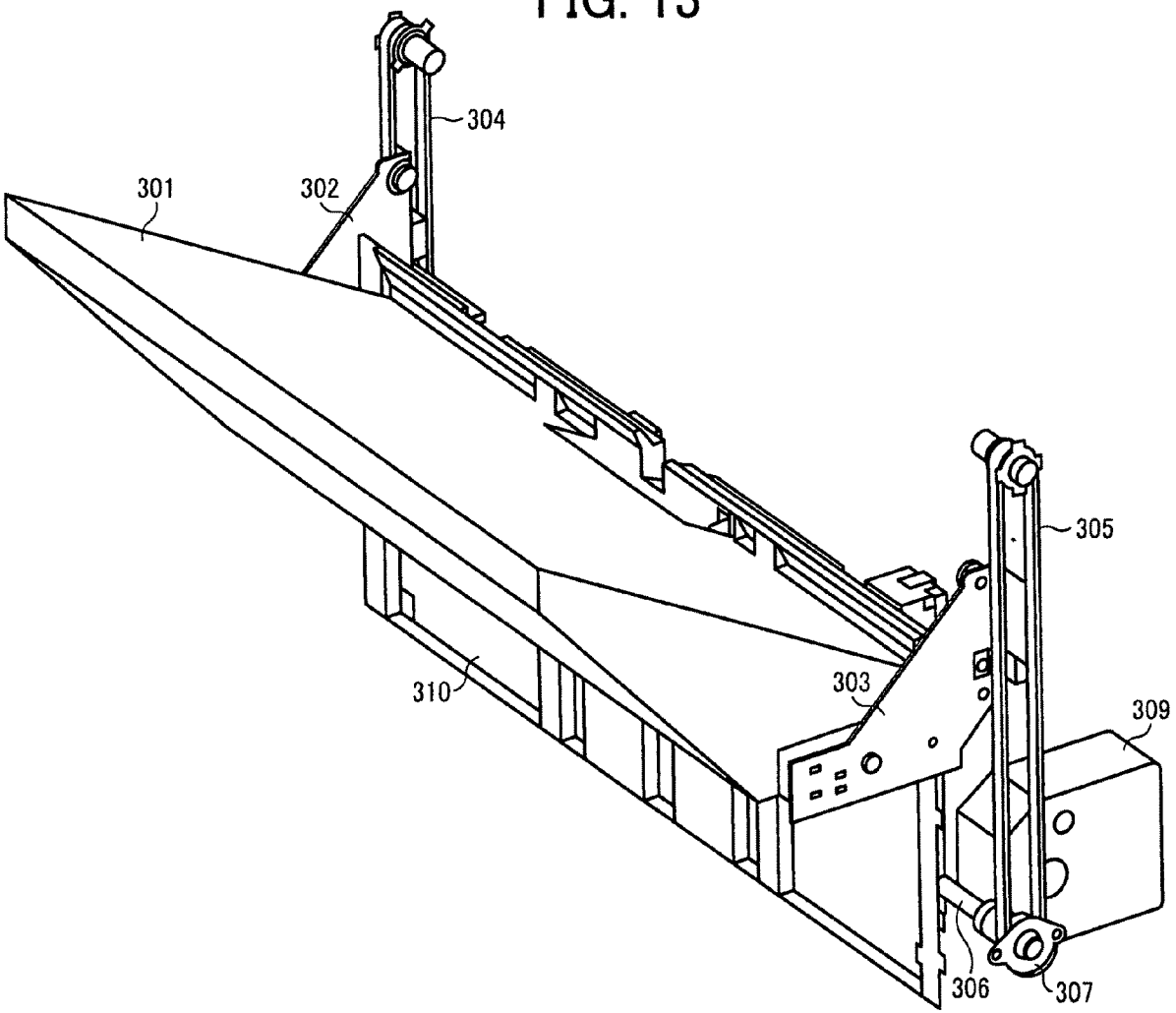
FIG. 13 is a perspective front view of a sheet output tray shown in FIG. 1.
Figure 14:
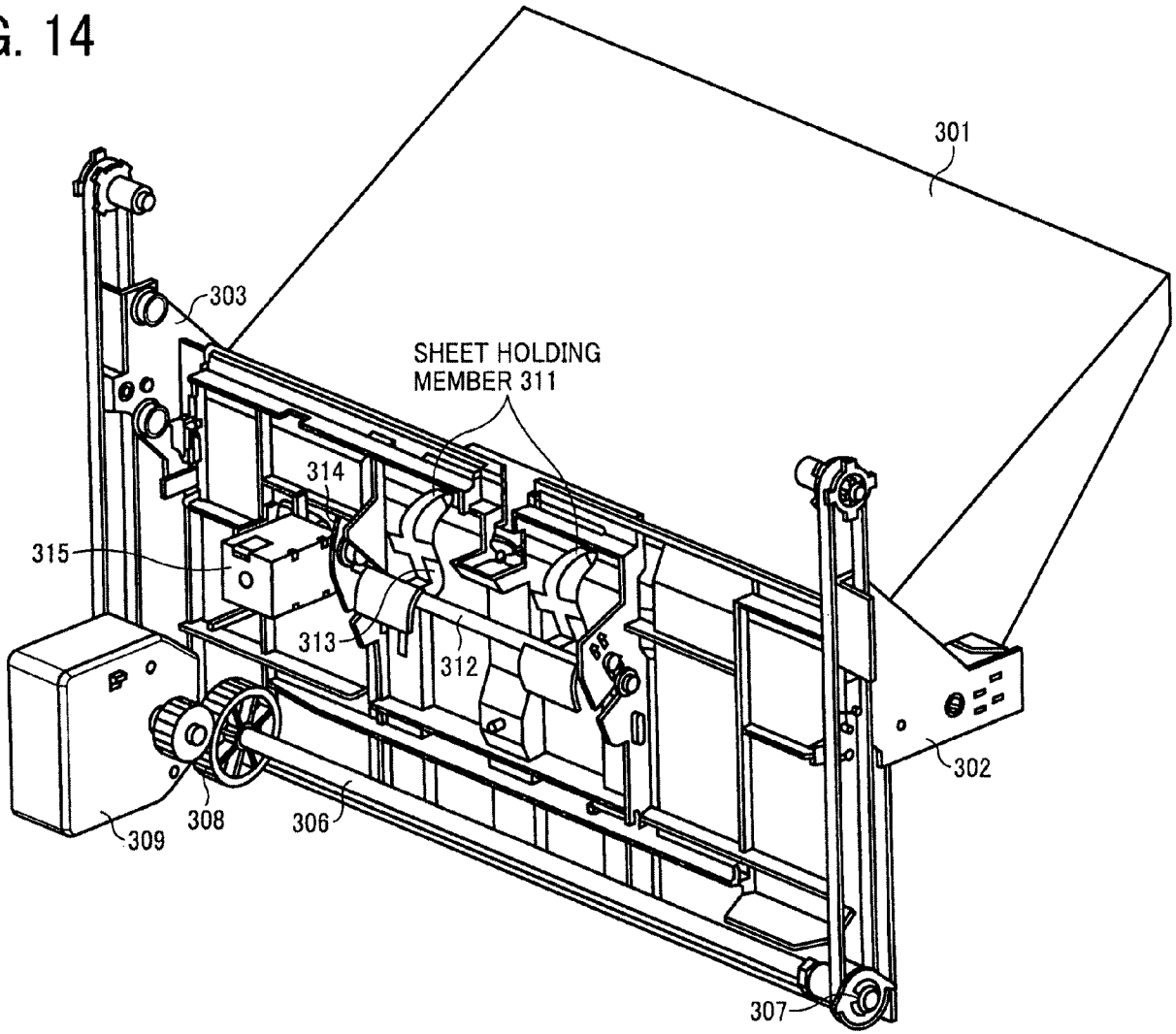
FIG. 14 is a perspective rear view of the sheet output tray shown in FIG. 1.
Figure 15:
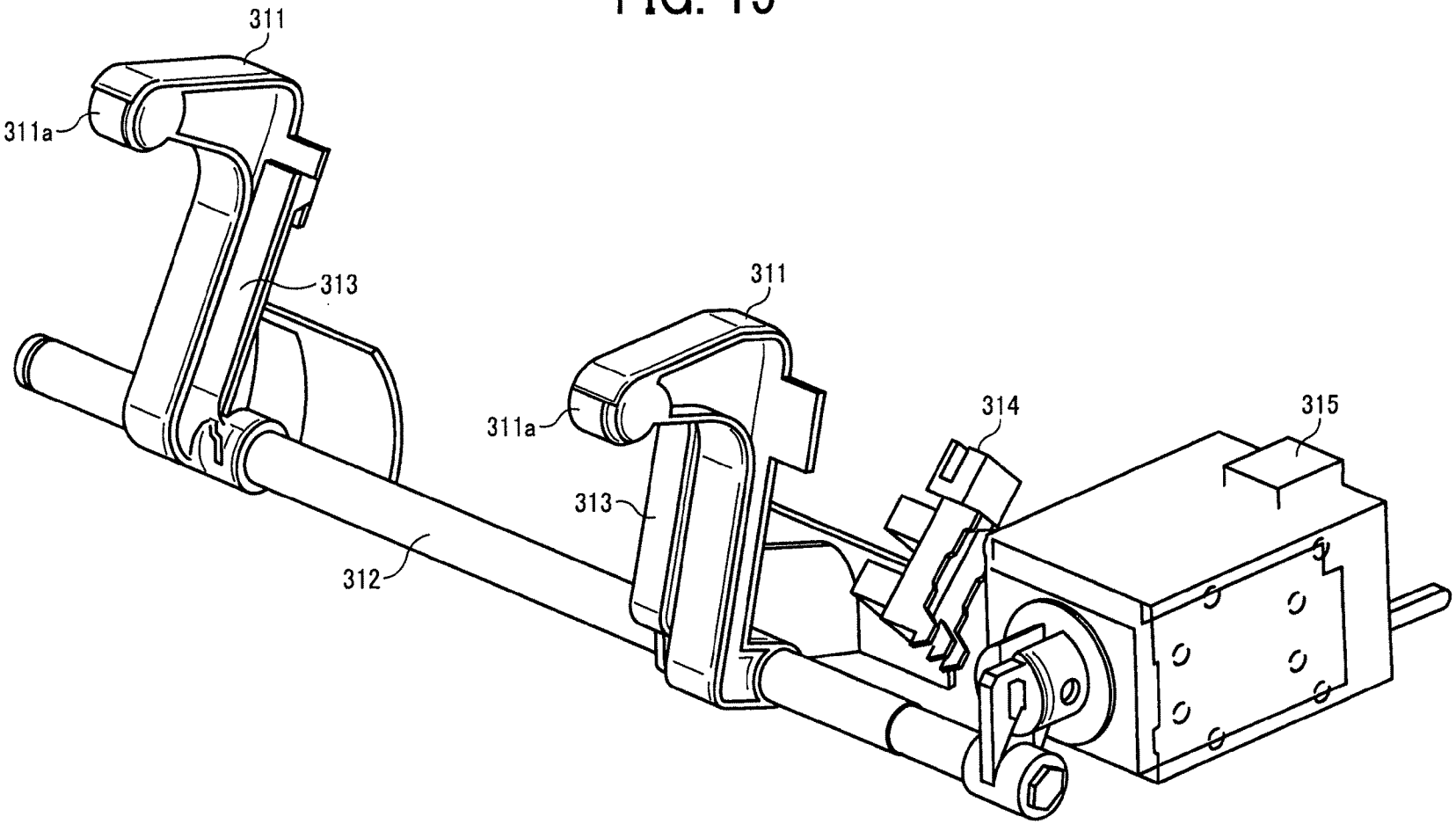
FIG. 15 is a perspective view of a main component of the sheet output tray shown in FIG. 1.
Figure 16A:
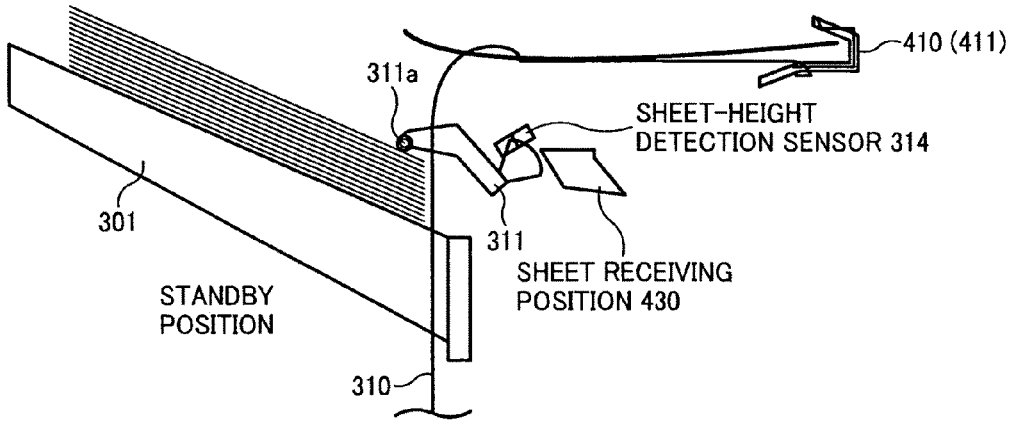
FIGS. 16A to 16D are schematic diagrams for explaining a sheet discharge operation performed by a sheet-stack discharging unit and the sheet output tray according to the embodiment.
Figure 16B:
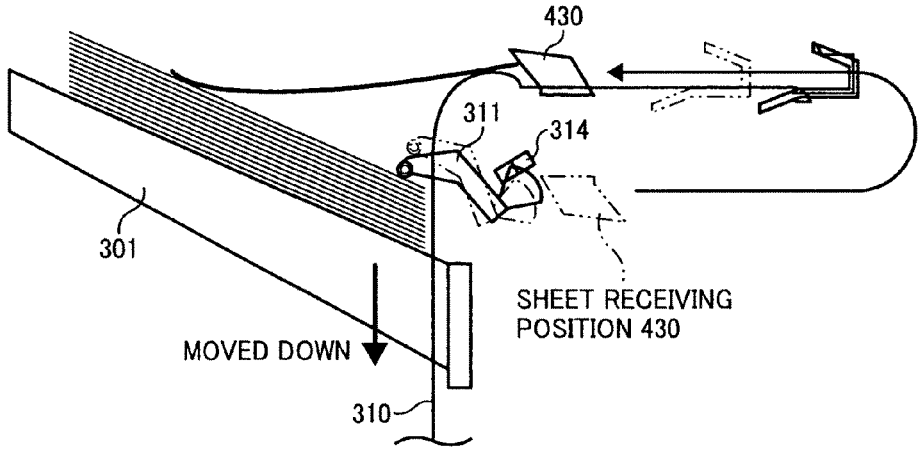
Figure 16C:
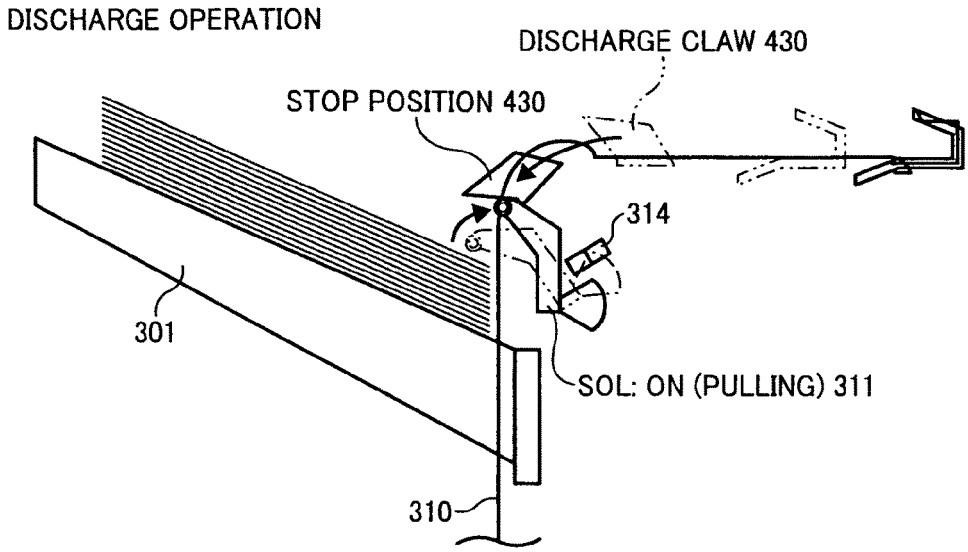
Figure 16D:
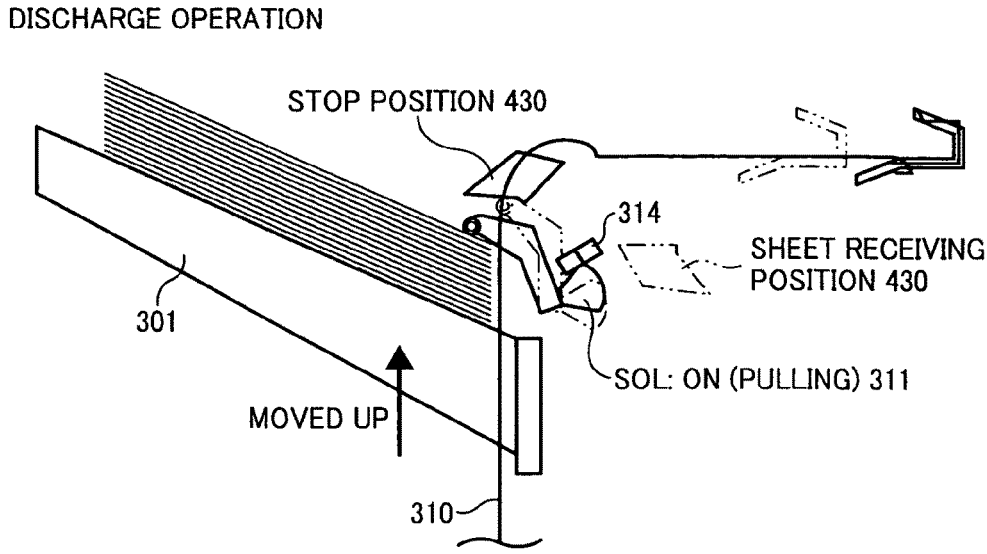

FIGS. 13 to 15 are perspective views of the sheet output tray 301 and main components of the sheet output tray 301.

The sheet output tray 301 is fixedly mounted on holding members 302 and 303. The holding members 302 and 303 are connected to a drive shaft 306 via a timing belt 304, a timing belt 305, and pulleys 307. The drive shaft 306 is engaged with a gear 308 such that the drive shaft 306 is connected to a DC motor 309 via the gear 308. The sheet output tray 301 is moved up and down due to rotation of the DC motor 309.

As shown in FIG. 1, an end fence 310 is arranged at an end portion of the sheet output tray 301 such that they cross each other at substantially right angles. Levers 313 are engaged with a rotation shaft 312, and the rotation shaft 312 is rotatably mounted on the end fence 310. Two sheet holding members 311 (sheet holding units) are rotatably mounted at around ends of the rotation shaft 312. Each of the sheet holding members 311 is provided with a pressurizing spring (not shown) that biases an end portion 311*a* of each of the sheet holding members 311 towards the end fence 310.

A DC/SOL 315 is fixedly mounted on a portion around one end of the rotation shaft 312. Due to operation of the DC/SOL 315, the rotation shaft 312 rotates in a reciprocating manner at a predetermined angle, so that the levers 313 rotate, rotating the sheet holding members 311.

The sheet holding members 311 are normally stopped due to the pressurizing spring such that the end portions 311*a* are protruded from a sheet alignment surface of the end fence 310. When the DC/SOL 315 performs a pulling operation, the sheet holding members 311 are rotated until the end portions 311*a* are placed completely behind the sheet alignment surface of the end fence 310.

A height of sheets stacked on the sheet output tray 301 is detected such that when the top surface of the sheets stacked on the sheet output tray 301 pushes up the end portions 311*a* protruded from the end fence 310, a sheet-height detection sensor 314 detects a detection portion arranged on the sheet holding members 311.

Operations performed by a sheet-stack discharging unit (e.g., the discharge rollers 208) and a sheet output tray (e.g., the sheet output tray 301) when discharging (outputting) a sheet is described below with reference to FIGS. 16A to 16D.

A standby position of the sheet output tray 301 at the time when the discharge rollers 208 discharge a sheet to the sheet aligning unit corresponds to either one of followings: one is a position at which the sheet-height detection sensor 314 detects the detection portion of the sheet holding members 311 after the sheet output tray 301 pushes up the end portions 311*a* of the sheet holding members 311; and the other is a position moved up for a predetermined height from the position detected by the sheet-height detection sensor 314. A sheet alignment operation and a sheet stapling operation are performed on a stack of sheets at the standby position (discharge operation in FIG. 16A).

A stack of sheets that has been aligned by the jogger fences 402 and 403 and sorted or stapled is then discharged onto the sheet output tray 301 by moving the discharge claw 430 to a sheet receiving position. At this time, the sheet output tray 301 is moved down for a predetermined time so that the sheet output tray 301 can receive the stack of sheets (discharge operation in FIG. 16B).

When the discharge claw 430 moves to a predetermined position, the discharge claw 430 temporarily stops while the DC/SOL 315 performs the pulling operation so that the sheet holding members 311 are rotated until they are placed completely behind the end fence 310. Then, the stack of sheets is fallen on the sheet output tray 301 (discharge operation in FIG. 16C).

Then, after a predetermined time elapses, the DC/SOL 315 is turned off, so that the sheet holding members 311 return to positions where they are protruded from the end fence 310. The sheet output tray 301 is then moved up and stopped at a position to which the top surface of the stack of sheets stacked on the sheet output tray 301 pushes up the sheet holding members 311 so that the sheet-height detection sensor 314 can detect a height of the stack of sheets, or is stopped after the sheet output tray 301 is moved up for a predetermined height from the position where the sheet-height detection sensor 314 detects the height of the stack of sheets. Then, the end portions 311*a* of the sheet holding members 311 hold around the trailing end of the stack of sheets, and the discharge claw 430 moves to the sheet receiving position, making them ready to receive a next discharged sheet (discharge operation in FIG. 15D).

The sheet post-processing apparatus 1 having the structure as shown in FIGS. 1 to 15 is configured to, as described with reference to FIGS. 11 and 12, accelerate the conveying speed of a sheet fed from the image forming apparatus from the receiving line speed V1 to the conveyor line speed V2 at a timing when the acceleration of the conveying speed is allowed. Accordingly, an interval between currently-conveyed sheet and a sheet to be fed can be increased, and the sheet alignment operation can be performed during the increased interval. Therefore, interferences between sequentially-conveyed sheets can be prevented.

However, when the sheet discharge operations described with reference to FIGS. 16A to 16D are performed, a sheet discharge process may not be finished within the interval increased by accelerating the conveying speed. In this case, sheet discharge operation or sheet receiving operation may not be performed normally.

Figure 17A:
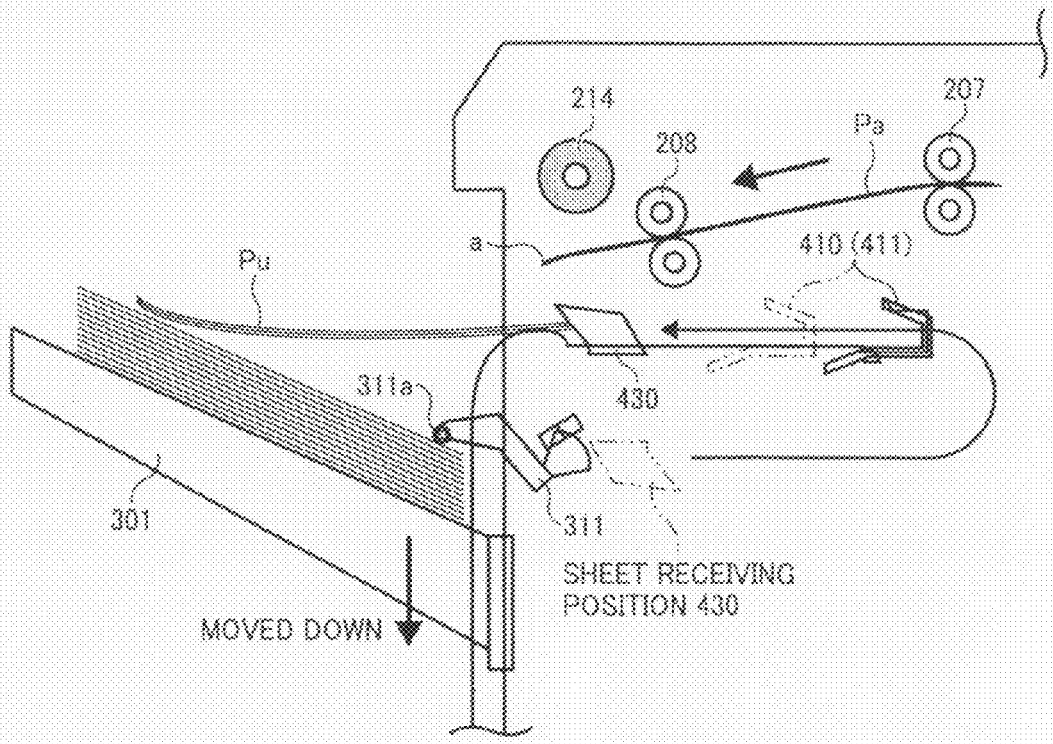
FIGS. 17A and 17B are schematic diagrams for explaining a situation in which a process from sheet discharging to sheet receiving is not performed normally.
Figure 17B:
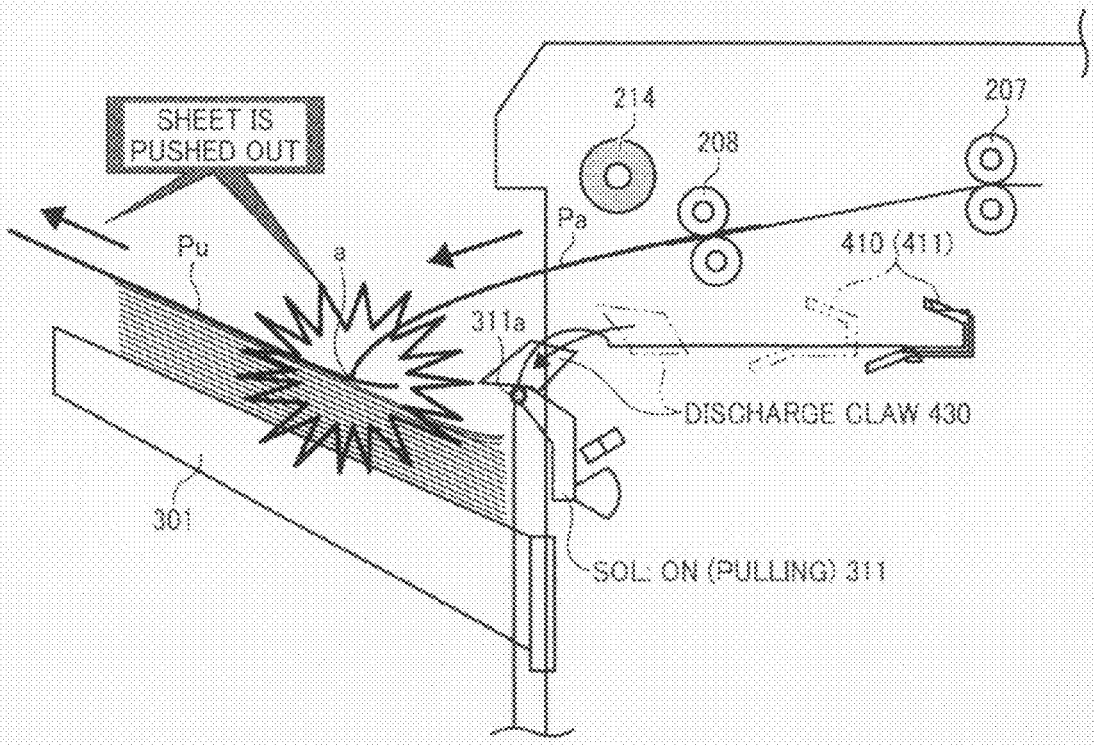

An exemplary situation when the sheet discharge operation or the sheet receiving operation is not performed normally is described with reference to FIGS. 17A and 17B. FIGS. 17A and 17B are schematic diagrams for explaining a situation in which a sheet in an unstapled stack of sheets stacked on the sheet output tray 301 is pushed out by a next sheet, and thereby the sheets on the sheet output tray 301 are misaligned.

FIG. 17A is a schematic diagram for explaining a situation in which the sheet post-processing apparatus 1 receives and conveys a sheet while a preceding stack of sheets that has been aligned by the staple tray 401 is being discharged onto the sheet output tray 301 by the discharge claw 430.

For the stack of sheets being discharged, the DC/SOL 315 performs the pulling operation such that the sheet holding members 311 are rotated until they are placed completely behind the end fence 310 so that the end portions 311*a* can hold around the trailing end of the stack of sheets.

However, if the stack of sheets stacked on the sheet output tray 301 is not stapled and when a sheet Pu at the top of the stack of sheets is not held by the sheet holding members 311, the sheet Pu can move freely. Therefore, when a leading end "a" of a next sheet Pa comes into contact with the sheet output tray 301 before the sheet holding members 311 hold the stack of sheets on the sheet output tray 301, the sheet Pu may be pushed out in a sheet discharge direction as shown in FIG. 17B. As a result, the stack of sheets on the sheet output tray 301 may be misaligned, and in the worst case, a sheet in the stack of sheets may fall off the sheet output tray 301.

Figure 18:
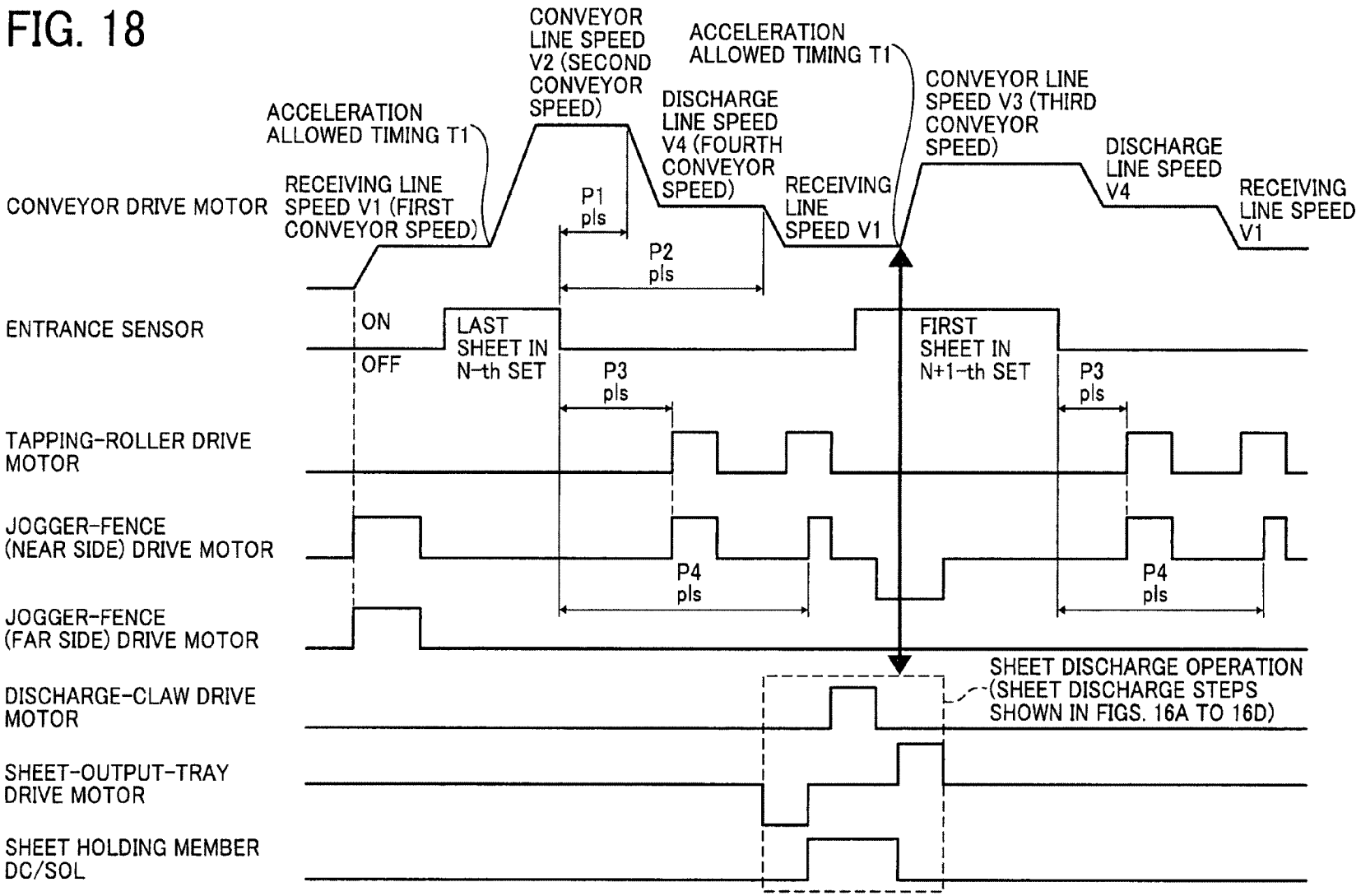
FIG. 18 is a timing diagram of a modified sheet conveying control according to the embodiment.
Figure 19:
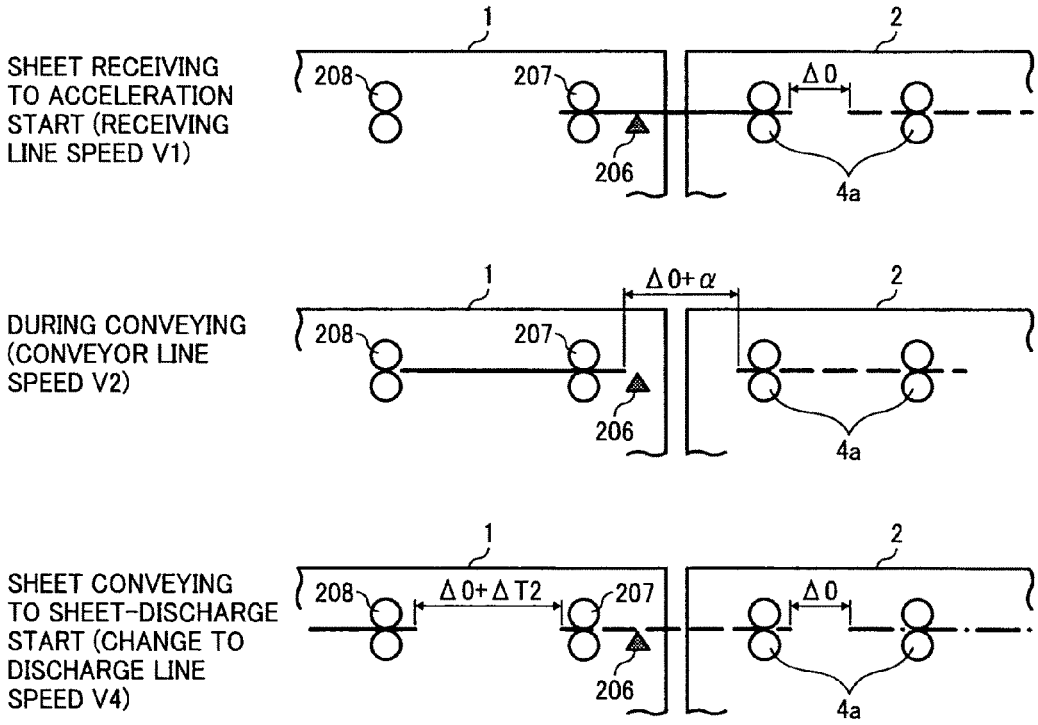
FIG. 19 is a schematic diagram for explaining timings of the modified sheet conveying control according to the embodiment.

To prevent the above situations, a sheet conveyor control as shown in FIGS. 18 and 19 is employed in the embodiment.

In FIGS. 18 and 19, when a first sheet in the N+1-th stack of sheets is fed from an image forming apparatus at the receiving line speed V1 and is conveyed until the acceleration allowed timing T1, and if a sheet in an N-th stack of sheets is being discharged onto the sheet output tray 301 by the discharge claw 430, the stepper motor 212 is accelerated to a conveyor line speed V3 (third conveying speed) that is slower than the conveyor line speed V2 for conveying the sheet ($V1 \leqq V3 < V2$).

Figure 11:
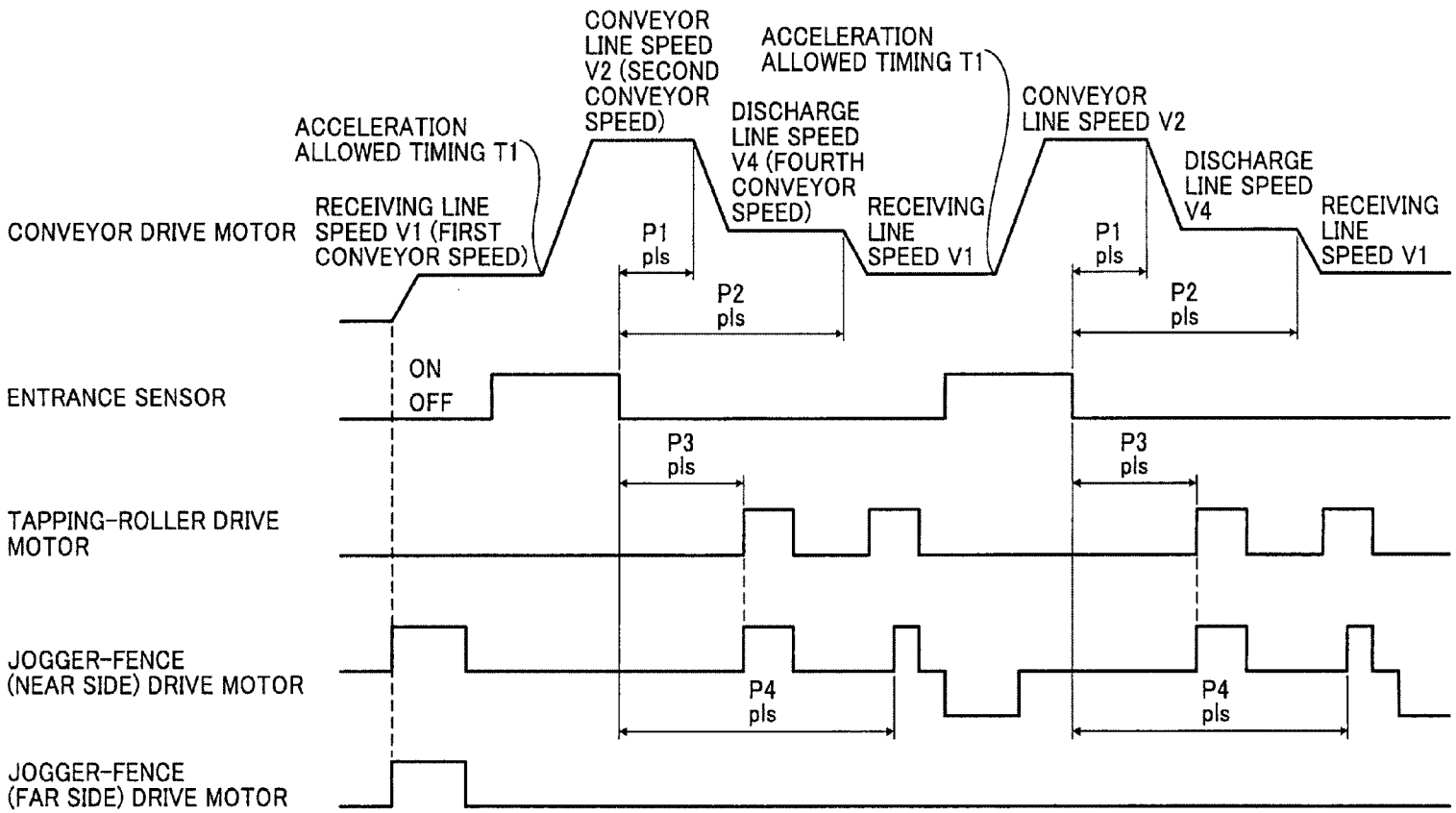
FIG. 11 is a timing diagram of a sheet conveying operation started from sheet receiving and ended with sheet alignment according to the embodiment.
Figure 12:
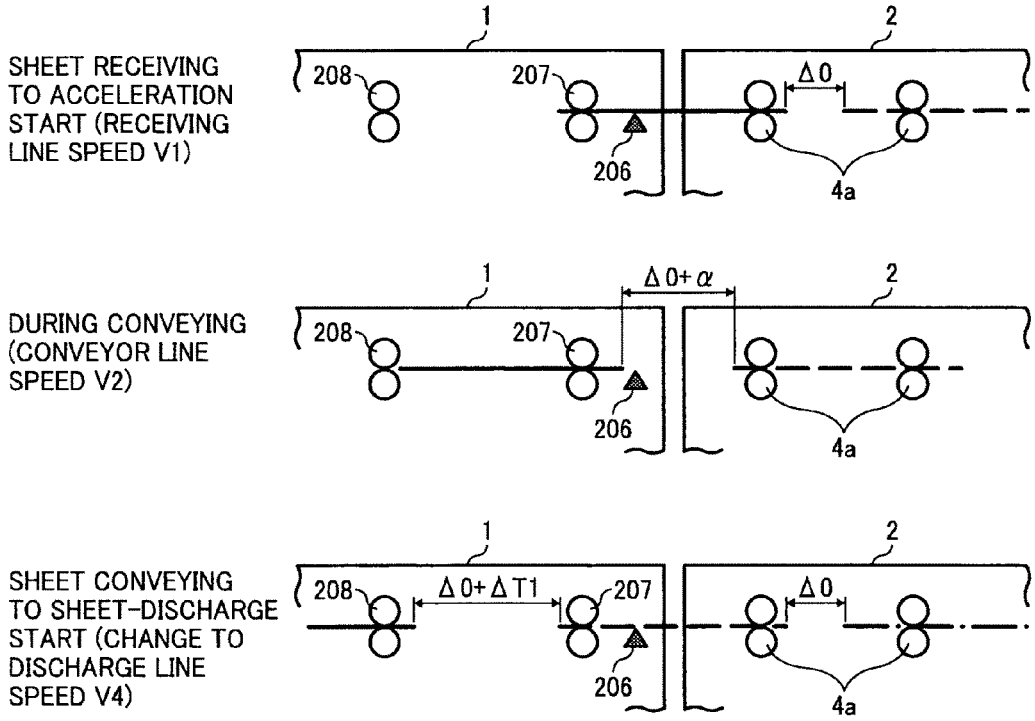
FIG. 12 is a schematic diagram for explaining timings of the sheet conveying operation started from sheet receiving and ended with sheet alignment according to the embodiment.

Accordingly, an interval between the last sheet in the N-th stack of sheets and the first sheet in the N+1-th stack of sheets can be increased by a time difference between a time when the last sheet in the N-th stack of sheets is conveyed at the conveyor line speed V2 and a time when the first sheet in the N+1-th stack of sheets is conveyed at the conveyor line speed V3, which is more increased compared with a time interval between sheets ($\Delta 0 + \Delta T1$) obtained by controlling the conveying speed in the example shown in FIGS. 11 and 12. Thus, the more increased time interval between sheets ($\Delta 0 + \Delta T2$) can be used for the sheet discharge operation on the N-th stack of sheets.

While an interval between the first sheet in the N+1-th stack of sheets and the second sheet in the N+1-th stack of sheets is shortened because of the above control, the conveyor line speed V2 and the conveyor line speed V3 are controlled so that interference between the sheets can hardly occur.

Figure 20:
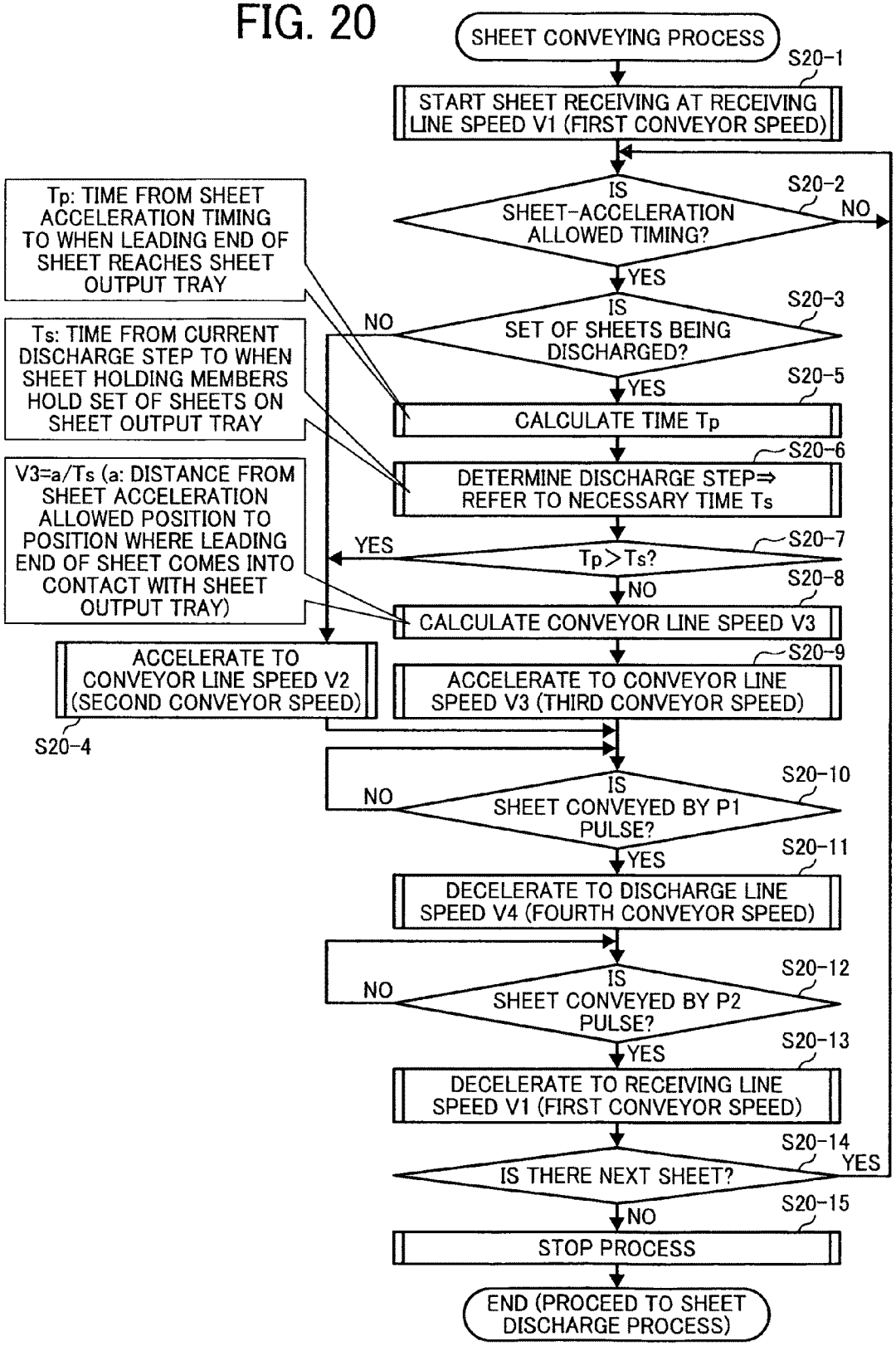
FIG. 20 is a flowchart of a process for receiving and conveying a sheet according to the embodiment.

A process procedure for receiving and conveying a sheet according to the embodiment, and a method of determining the conveyor line speed V3 are described below with reference to FIGS. 20 and 21.

The sheet post-processing apparatus 1 receives a sheet fed from the image forming apparatus at the receiving line speed V1 (Step S20-1), and conveys the sheet until the acceleration allowed timing T1 that is counted by the number of driving pulses of the stepper motor 212 (Step S20-2). At the acceleration allowed timing T1, the sheet post-processing apparatus 1 determines whether a preceding stack of sheets is being discharged onto the sheet output tray 301 by the sheet-stack discharging unit (whether a sheet discharge operation is performed) (Step S20-3). When the sheet discharge operation is not performed, the conveying speed of the sheet is accelerated to the conveyor line speed V2 (Step S20-4). On the other hand, when the sheet discharge operation is being performed, the sheet post-processing apparatus 1 calculates a time Tp necessary for conveying the sheet at the conveyor line speed V2 from a position corresponding to the acceleration allowed timing T1 to a position where the leading end of the sheet reaches the sheet output tray 301 (Step S20-5).

Figure 22:
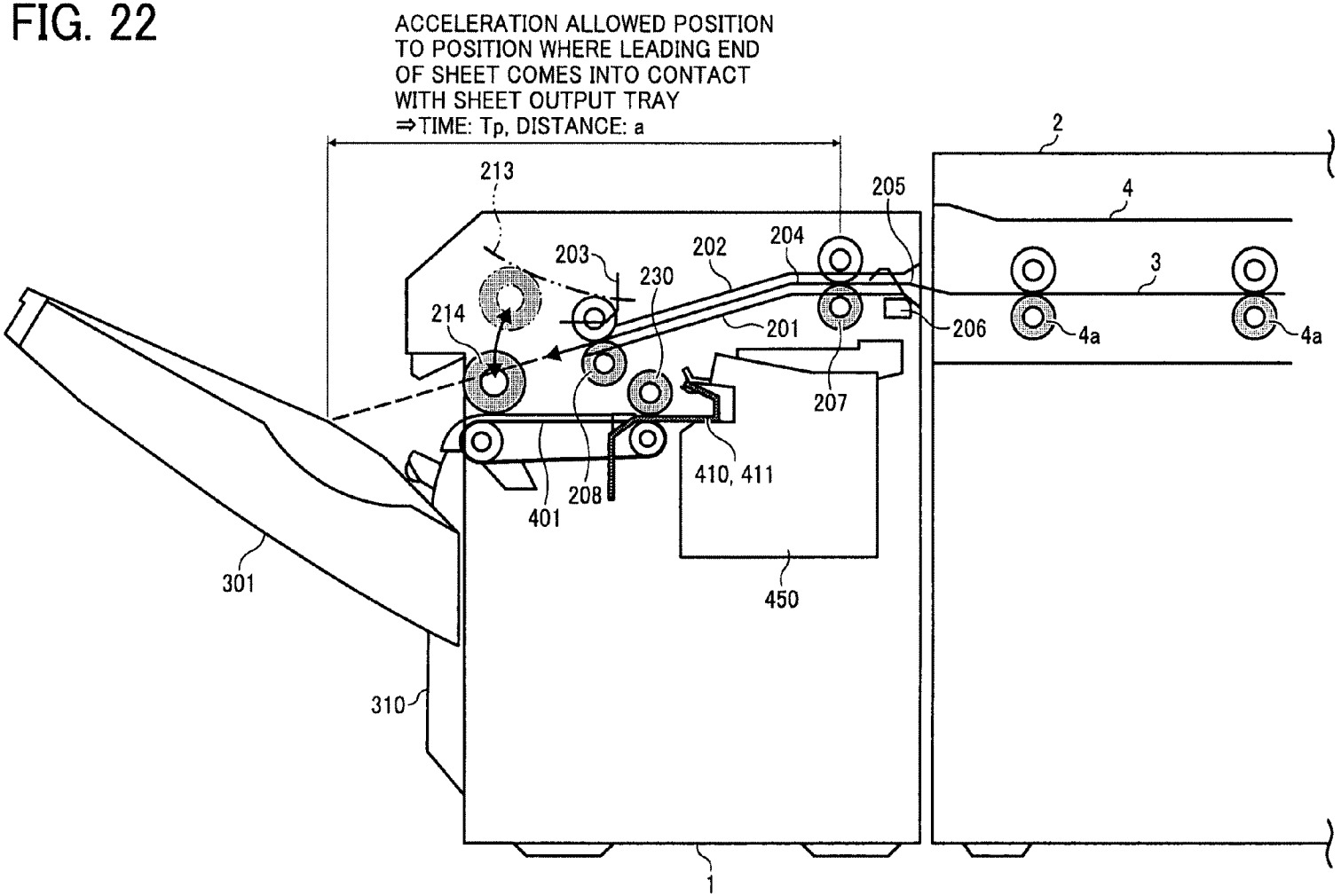
FIG. 22 is a schematic diagram for explaining a time from a sheet acceleration timing to a time when a leading end of a sheet reaches the sheet output tray according to the embodiment.

The acceleration allowed timing T1 corresponds to a timing when the leading end of the sheet reaches the conveyor rollers 207. Therefore, as shown in FIG. 22, when assuming that "a" is a conveyor distance from where the leading end of the sheet reaches the conveyor rollers 207 to where the leading end of the sheet reaches the sheet output tray 301, the time Tp necessary for conveying the sheet from a position corresponding to the acceleration allowed timing Ta to a position where the leading end of the sheet reaches the sheet output tray 301 can be obtained by the following calculation equation: TP=a/V2.

Then, the sheet post-processing apparatus 1 calculates a time Ts necessary for the sheet discharge operation, that is, a time taken from a current discharge step of the sheet discharge operation performed by the sheet-stack discharging unit and the sheet output tray until the sheet holding members 311 hold the stack of sheets on the sheet output tray 301 (Step S20-6)

Figure 21:
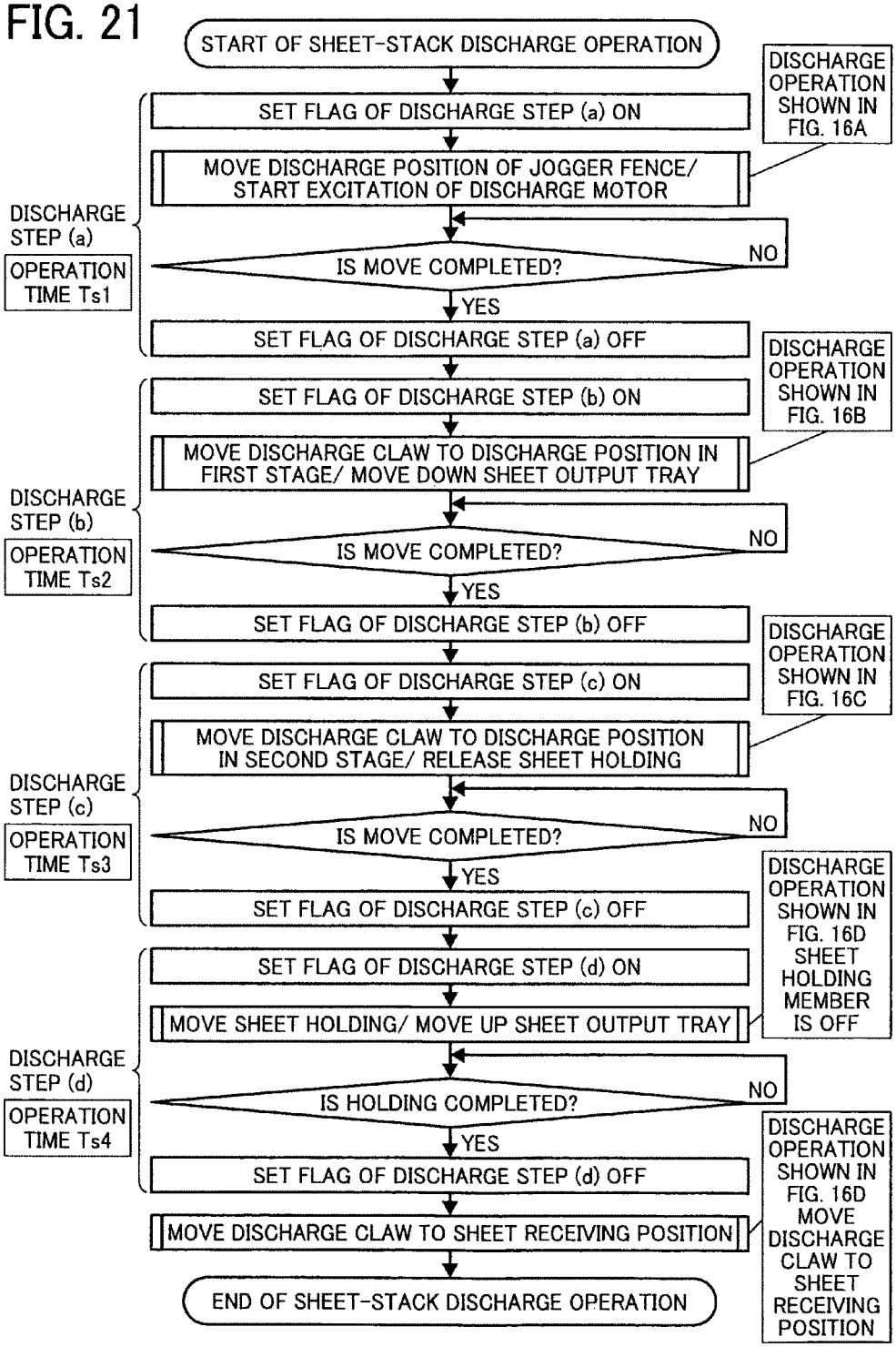
FIG. 21 is a flowchart of processes in the sheet discharge operation shown in FIGS. 16A to 16D.

The time Ts necessary for the sheet discharge operation is determined depending on at what step among steps (a) to (d) of a flowchart in FIG. 21 the discharge operation is, and calculated by summing times necessary for a process at the current step and processes at subsequent steps.

In FIG. 21, operational flows from a start to an end of the sheet discharge operations shown in FIGS. 16A to 16D are described as four discharge steps (a) to (d), respectively. Times necessary for the discharge steps (a) to (d) are represented by Ts1, Ts2, Ts3, and Ts4, respectively.

For example, when the current discharge step corresponds to the discharge step (b), Ts=Ts2+Ts3+Ts4.

The sheet post-processing apparatus 1 compares the time Tp obtained at Step S20-5 with the time Ts obtained at Step S20-6 (Step S20-7). If Tp>Ts, the sheet post-processing apparatus 1 determines that, even when the sheet conveying speed is accelerated to the conveyor line speed V2, the sheet holding members 311 can hold the stack of sheets on the sheet output tray 301 before the leading end of a subsequent sheet comes into contact with the sheet output tray 301 so that a sheet in the stack of sheets on the sheet output tray 301 can hardly be pushed out. Therefore, the sheet post-processing apparatus 1 accelerates the conveying speed to the conveyor line speed V2 (Step S20-4).

On the other hand, if Tp<Ts, the sheet post-processing apparatus 1 calculates the conveyor line speed V3 at which a sheet in the stack of sheets on the sheet output tray 301 can hardly be pushed out (Step S20-8), and accelerates the conveying speed to the conveyor line speed V3 (Step S20-9).

The conveyor line speed V3 can be obtained by the following calculation equation: V3=a/Ts, where "a" is a conveyor distance for conveying the sheet from where the leading end of the sheet reaches the conveyor rollers 207 to where the leading end of the sheet reaches the sheet output tray 301.

The conveying speed accelerated to either the conveyor line speed V2 or the conveyor line speed V3 is decelerated to a discharge line speed V4 (fourth conveying speed) when the sheet is conveyed by P1 pulse (Steps S20-10 and S20-11). After the sheet is conveyed by P2 pulse, the conveying speed is decelerated to the receiving line speed V1 (Steps S20-12 and S20-13). If there is a next sheet, the next sheet is sequentially conveyed. If there are no next sheets, a process for conveying the sheet is finished, and the sheet discharge process is started (Steps S20-14 and S20-15).

According to one aspect of the present invention, the sheet processing apparatus can assure a sheet-stack processing time even when a sheet conveying path is short. Therefore, a processing performance on a sheet conveyed at a predetermined time interval can be assured. As a result, it is possible to prevent a sheet or a sheet conveying unit from being damaged, and post processing on the sheet can be performed effectively.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a conveying unit that conveys a sheet from an upper-level apparatus;

a conveyance control unit that changes a conveying speed of the sheet from a first conveying speed to a second conveying speed to extend an interval between a current sheet and a next sheet from the upper-level device increases;

a first tray unit that stacks therein the sheet conveyed by the conveying unit;

an aligning unit that aligns sheets stacked in the first tray unit;

a second tray unit that stacks therein a stack of sheets discharged from the first tray unit;

a discharging unit that discharges the stack of sheets from the first tray unit to the second tray unit; and a holding unit that holds a trailing end of the stack of sheets stacked in the second tray unit, wherein when a sheet is conveyed to an acceleration position where the conveying speed can be changed from the first conveying speed to the second conveying speed while the discharging unit is discharging a preceding stack of sheets, the conveyance control unit calculates a third conveying speed for conveying the sheet based on a first conveyance time to be taken until a leading end of the stack of sheets reaches the second tray unit and a second conveyance time to be taken until a current discharging operation of the stack of sheets is completed from a start of the current discharging operation, and changes the conveying speed from the first conveying speed to the third conveying speed, wherein after changing the conveying speed from the first conveying speed to either one of the second conveying speed and the third conveying speed, the conveyance control unit changes the conveying speed from either one of the second conveying speed and the third conveying speed to a fourth conveying speed before the sheet is conveyed to the first tray unit.

2. The sheet processing apparatus according to claim 1, wherein the second conveyance time is from when the sheet reaches the acceleration position to when the holding unit holds a trailing end of the preceding stack of sheets stacked in the second tray unit.

3. The sheet processing apparatus according to claim 1, wherein the first conveying speed is equal to or slower than the third conveying speed and the third conveying speed is slower than the second conveying speed.

4. The sheet processing apparatus according to claim 1, wherein the aligning unit includes a trailing-end aligning unit for aligning the sheet stacked in the first tray unit in a sheet conveying direction, and a pair of alignment plates for aligning the sheet in a sheet width direction, and the aligning unit moves the sheet stacked in the first tray unit in a direction opposite to the sheet conveying direction such that a trailing end of the sheet abuts the trailing-end aligning unit to align the sheet in the sheet conveying direction, and aligns the sheet in the sheet width direction using the alignment plates.

5. The sheet processing apparatus according to claim 1, wherein the conveyance control unit changes the conveying speed from the first conveying speed to the second conveying speed to assure a processing time for performing an alignment operation by the aligning unit, and changes the conveying speed from the first conveying speed to the third conveying speed to assure the processing time for the alignment operation and a processing time for discharging the stack of sheets by the discharging unit.

6. A sheet processing method comprising:

conveying a sheet from an upper-level apparatus to a first tray unit;

controlling including changing a conveying speed of the sheet from a first conveying speed to a second conveying speed to extend an interval between a current sheet and a next sheet from the upper-level device increases;

aligning sheets stacked in the first tray unit;

discharging a stack of sheets from the first tray unit to a second tray unit; and holding a trailing end of the stack of sheets stacked in the second tray unit, wherein when a sheet is conveyed to an acceleration position where the conveying speed can be changed from the first conveying speed to the second conveying speed while a preceding stack of sheets is discharged at the discharging, the controlling includes calculating a third conveying speed for conveying the sheet based on a first conveyance time to be taken until a leading end of the stack of sheets reaches the second tray unit and a second conveyance time to be taken until a current discharging operation of the stack of sheets is completed from a start of the current discharging operation and changing the conveying speed from the first conveying speed to the third conveying speed, wherein after the conveying speed is changed from the first conveying speed to either one of the second conveying speed and the third conveying speed, the controlling further includes changing the conveying speed from either one of the second conveying speed and the third conveying speed to a fourth conveying speed before the sheet is conveyed to the first tray unit.

7. The sheet processing method according to claim 6, wherein the second conveyance time is from when the sheet reaches the acceleration position to when a trailing end of the preceding stack of sheets stacked in the second tray unit is held at the holding.

8. The sheet processing method according to claim 6, wherein the first conveying speed is equal to or slower than the third conveying speed and the third conveying speed is slower than the second conveying speed.

9. The sheet processing method according to claim 6, wherein the aligning includes moving the sheet stacked in the first tray unit in a direction opposite to a sheet conveying direction such that a trailing end of the sheet abuts a trailing-end aligning unit to align the sheet in the sheet conveying direction, and aligning the sheet in the sheet width direction using a pair of alignment plates.

10. The sheet processing method according to claim 6, wherein the controlling includes changing the conveying speed from the first conveying speed to the second conveying speed to assure a processing time for performing an alignment operation at the aligning, and changing the conveying speed from the first conveying speed to the third conveying speed to assure the processing time for the alignment operation and a processing time for discharging the stack of sheets at the discharging.

11. An image forming apparatus comprising a sheet processing device including, a conveying unit that conveys a sheet from an upper-level apparatus;

a conveyance control unit that changes a conveying speed of the sheet from a first conveying speed to a second conveying speed to extend an interval between a current sheet and a next sheet from the upper-level device increases;

a first tray unit that stacks therein the sheet conveyed by the conveying unit;

an aligning unit that aligns sheets stacked in the first tray unit;

a second tray unit that stacks therein a stack of sheets discharged from the first tray unit;

a discharging unit that discharges the stack of sheets from the first tray unit to the second tray unit; and a holding unit that holds a trailing end of the stack of sheets stacked in the second tray unit, wherein when a sheet is conveyed to an acceleration position where the conveying speed can be changed from the first conveying speed to the second conveying speed while the discharging unit is discharging a preceding stack of sheets, the conveyance control unit calculates a third conveying speed for conveying the sheet based on a first conveyance time to be taken until a leading end of the stack of sheets reaches the second tray unit and a second conveyance time to be taken until a current discharging operation of the stack of sheets is completed from a start of the current discharging operation, and changes the conveying speed from the first conveying speed to the third conveying speed, wherein after changing the conveying speed from the first conveying speed to either one of the second conveying speed and the third conveying speed, the conveyance control unit changes the conveying speed from either one of the second conveying speed and the third conveying speed to a fourth conveying speed before the sheet is conveyed to the first tray unit.

12. The image forming apparatus according to claim 11, wherein the second conveyance time is from when the sheet reaches the acceleration position to when the holding unit holds a trailing end of the preceding stack of sheets stacked in the second tray unit.

13. The image forming apparatus according to claim 11, wherein the first conveying speed is equal to or slower than the third conveying speed and the third conveying speed is slower than the second conveying speed.

14. The image forming apparatus according to claim 11, wherein the aligning unit includes a trailing-end aligning unit for aligning the sheet stacked in the first tray unit in a sheet conveying direction, and a pair of alignment plates for aligning the sheet in a sheet width direction, and the aligning unit moves the sheet stacked in the first tray unit in a direction opposite to the sheet conveying direction such that a trailing end of the sheet abuts the trailing-end aligning unit to align the sheet in the sheet conveying direction, and aligns the sheet in the sheet width direction using the alignment plates.

15. The image forming apparatus according to claim 11, wherein the conveyance control unit changes the conveying speed from the first conveying speed to the second conveying speed to assure a processing time for performing an alignment operation by the aligning unit, and changes the conveying speed from the first conveying speed to the third conveying speed to assure the processing time for the alignment operation and a processing time for discharging the stack of sheets by the discharging unit.

* * * * *